US006357634B1

(12) United States Patent
Evans et al.

(10) Patent No.: US 6,357,634 B1
(45) Date of Patent: Mar. 19, 2002

(54) CONTAINER CAP DISPENSING APPARATUS

(75) Inventors: Christopher T. Evans; Chris Gieda, both of Long Valley; Kenneth R. Jones, Wayne, all of NJ (US)

(73) Assignee: Sussex Technology Inc., Sparta, NJ (US)

( * ) Notice: Subject to any disclaimer, the term of this patent is extended or adjusted under 35 U.S.C. 154(b) by 0 days.

(21) Appl. No.: 09/689,558

(22) Filed: Oct. 12, 2000

Related U.S. Application Data

(60) Provisional application No. 60/175,652, filed on Jan. 12, 2000, and provisional application No. 60/158,856, filed on Oct. 12, 1999.

(51) Int. Cl.[7] ..... B67D 3/00
(52) U.S. Cl. ..... 222/525
(58) Field of Search ..... 222/525

(56) References Cited

U.S. PATENT DOCUMENTS

| | | | | |
|---|---|---|---|---|
| 3,844,455 | A | 10/1974 | Stull | |
| 4,402,693 | A | 9/1983 | Roseman et al. | 604/890 |
| 4,438,870 | A | 3/1984 | Stull | |
| 4,569,612 | A | 2/1986 | Schwartzman et al. | 401/206 |
| 4,620,648 | A | 11/1986 | Schwartzman | 222/490 |
| 4,693,623 | A | 9/1987 | Schwartzman | 401/206 |
| 4,805,807 | A | 2/1989 | Perne et al. | 222/153 |
| 5,772,076 | A | 6/1998 | Juk et al. | 222/153.06 |
| 5,909,738 | A | 6/1999 | Quennessen | |
| 6,000,567 | A | 12/1999 | Carlsson et al. | 215/252 |

OTHER PUBLICATIONS

Declaration of Christopher T. Evans, and Drawing Attachment.

*Primary Examiner*—Philippe Derakshani
(74) *Attorney, Agent, or Firm*—Duane, Morris & Heckscher LLP

(57) ABSTRACT

A container cap dispensing apparatus includes a cover member and a base member. The cover member is disposed over a portion of the base member, and the base member is secured to a container. The cover member is secured to either the base member or the container to allow the cover member to rotate relative to the container. The cover member and base member cooperate to drive a plug of the base member axially away from a dispensing opening defined in the cover member in order to permit the discharge of contents from an attached container. The cover member is permitted to rotate relative to the container but is not displaced axially relative to the base member.

35 Claims, 22 Drawing Sheets

10

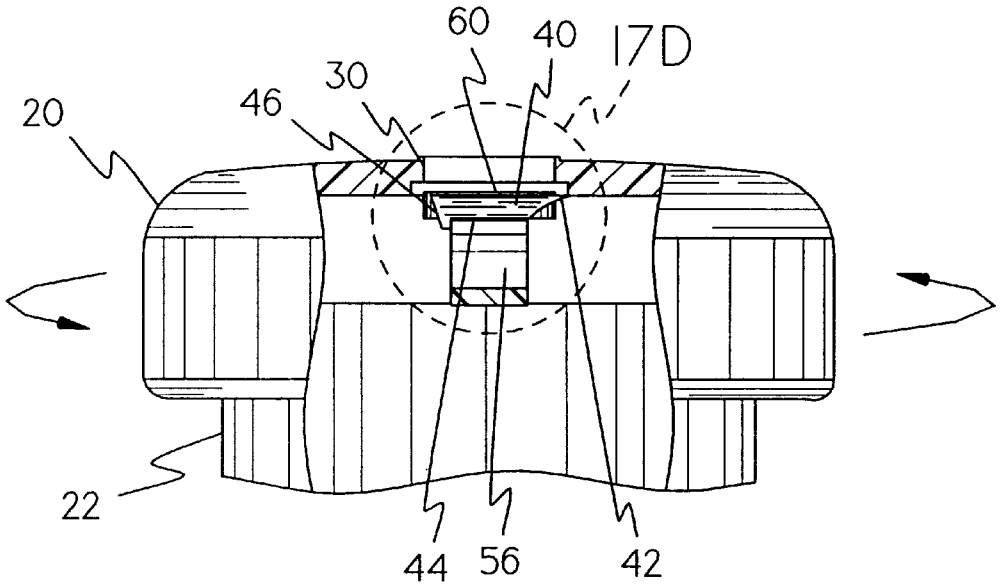
Fig. 17C
Fig. 17D
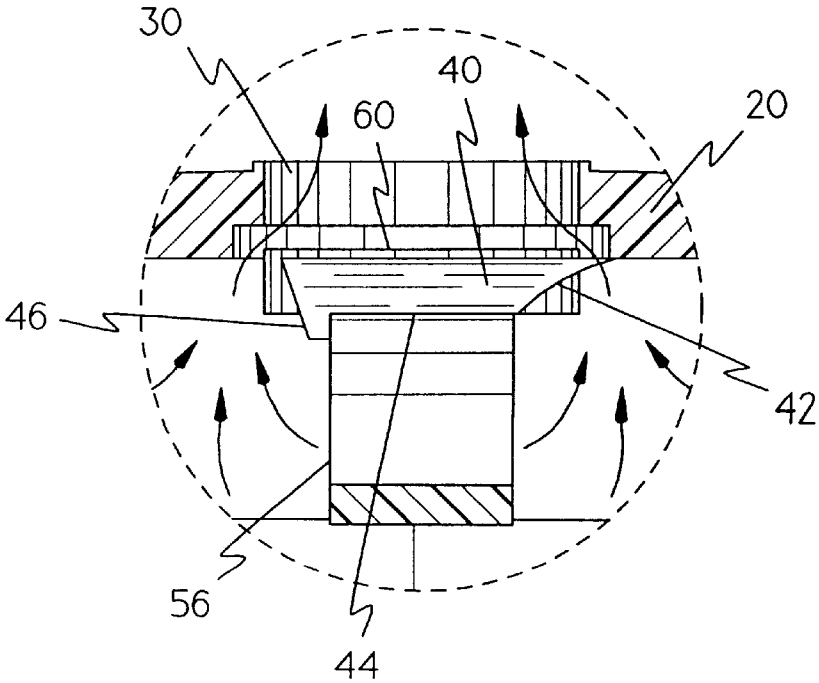

CONTAINER CAP DISPENSING APPARATUS

CROSS-REFERENCE TO RELATED APPLICATIONS

This application claims priority from U.S. provisional application Ser. No. 60/158,856 entitled "Twist to open dispensing closure assembly," filed Oct. 12, 1999 and U.S. provisional application Ser. No. 60/175,652 entitled "Container cap dispensing apparatus," filed Jan. 12, 2000, the entirety of which are hereby incorporated by reference.

FIELD OF THE INVENTION

The present invention relates to dispensing cap constructions for dispensing a liquid or a semi-solid product from a container, and more particularly to a screw cover cap and base cap construction that displaces a portion of the base cap relative to an opening in the screw cap in order to permit the liquid or semi-solid product to be dispensed.

DESCRIPTION OF THE RELATED ART

Current dispensing cap constructions for dispensing a liquid or a semi-solid product from a container are of the conventional cone-shaped type, such as is often found on the top of a squeeze container for mustard or ketchup. Typically, the dispensing cap is comprised of two caps, a cover cap and a base cap. The base cap is attached to a container, often by screwing the base cap to the container, and the cover cap is placed over a portion of the base cap.

The base cap contains a tubular body with a discharge spout located on the tubular body. A plug or a stopper is positioned at a top end of the tubular body. The cover cap has a discharge opening at its top end that is sized to accept the plug or stopper of the base cap.

The cover cap and the base cap are mutually engaged by a set of cooperable screw threads on each of the two caps. This construction permits the cover cap to move axially relative to the base cap when the cover cap is rotated. When the cover cap is fully rotated in the clockwise direction, the plug of the tubular body occupies the discharge opening of the cover cap and prevents discharge of the contents of the container through the tubular body and discharge spout of the base cap to the discharge opening of the cover cap. Conversely, when the cover cap is rotated in the counter-clockwise direction, the cover cap and the discharge opening rise away from the plug or stopper of the base cap. When the discharge opening rises above the plug or stopper, product from the container is permitted to flow through the tubular body and its spout and out the discharge opening.

Several problems arise from this conventional construction. First, a gap is formed between the cover cap and the base cap when the cover cap is rotated counter-clockwise into the "open" position. This gap presents an unsightly appearance and increases the likelihood that the cover cap will be dislodged from the base cap. For example, when the cover cap is rotated into the "open" position, and thus the gap is present, the cover cap may be easily dislodged from the base cap by a child, the dangers of which should be obvious. Also, the cover cap may be dislodged from the base cap if a person lifts the container by the cover cap or if the container is dropped. If the cover cap is removed, the contents of the container can flow unencumbered through the tubular body and discharge spout of the base cap. Further, the conventional construction uses lugs to accompany the screw threads in order to limit the range of rotation of the cover cap. These lugs help prohibit the cover cap from rotating too far into a position where it can be easily dislodged from the base cap when the cover cap is rotated to the "open" position. These lugs, however, can be stripped if too much rotational force is applied to the cover cap, thereby negating their effectiveness.

Therefore, there is presently a need for an improved dispensing cap construction that eliminates the problems associated with the conventional cap construction.

SUMMARY OF THE INVENTION

The present invention is a container cap dispensing apparatus comprising a base cap and a cover cap. The base cap includes a tubular body portion having a top end and a bottom end and a discharge opening located between the top and bottom ends, a plug located near the top end, and a base portion located near the bottom end, which includes fastening means for securing the base cap to a container. The base cap further includes a flexible membrane connecting the tubular body portion to the base portion. The cover cap has a top end and a bottom end and a dispensing opening near the top end thereof for discharging the contents of the container. The cover cap is swivally mounted relative to the base cap. The dispensing opening is sized to selectively accept the plug of the base cap. The base cap and cover cap contain cooperable joining means including thread means for permitting the tubular body portion to be moved axially through a displacement of the flexible membrane when the cover cap is rotated relative to the base cap, for example, thereby enabling a discharge of the contents of the container.

This dispensing cap construction provides several benefits over conventional cap constructions. For example, the container maintains a similar appearance to the prior art when in the "closed" position, but the dispensing cap has an improved aesthetic appearance when in the "open" position because the unsightly gap is eliminated that forms between the cover cap and base cap. Also, by eliminating the gap, the dispensing cap construction prevents the cover cap from being easily dislodged from the base cap. Further, the construction negates the need for lugs to be used in conjunction with the cooperable thread means. This construction, therefore, provides a safer and aesthetically pleasing dispensing cap, as well as greatly reduces the potential for unwanted discharges.

In another embodiment of the present invention, the container cap dispensing apparatus includes a toggle sleeve member and a cap member. The toggle sleeve member comprises a side wall defining a continuous passage through the toggle sleeve member from a top end of the toggle sleeve member to a bottom end of the toggle sleeve member, a fastening means for securing the toggle sleeve member to a container, and a bridge strap extending across the passage. The bridge strap is bowed toward the top end of the toggle sleeve member and includes a button extending from the bridge strap toward the top end. The cap member is disposed over a portion of the toggle sleeve member and includes a top wall defining a discharge opening and disposed to accept the button. The cap member also includes a skirt wall extending continuously from the top wall and a pair of diametrically opposed cam portions extend from a bottom surface of the top wall. One of the members includes an annular groove, and the annular groove mates with a protrusion extending from the other of the members. The button is displaced from the discharge opening when the cap member is rotated along the annular groove through a camming of the bridge strap, whereby a discharge of the contents of the container is enabled.

The above and other advantages and features of the present invention will be better understood from the following detailed description of the preferred embodiments of the invention which is provided in connection with the accompanying drawings.

BRIEF DESCRIPTION OF THE DRAWINGS

FIGS. 17A–17C inclusive are side elevational views partly in section showing the relative position of the parts to activate the container cap dispensing apparatus from a closed to an open position;

FIG. 17D is an enlarged, sectional view of the area of FIG. 17C marked 17D showing the parts in the fully open position to permit discharge of content in the manner shown by the arrows;

DETAILED DESCRIPTION

Figure 1B:
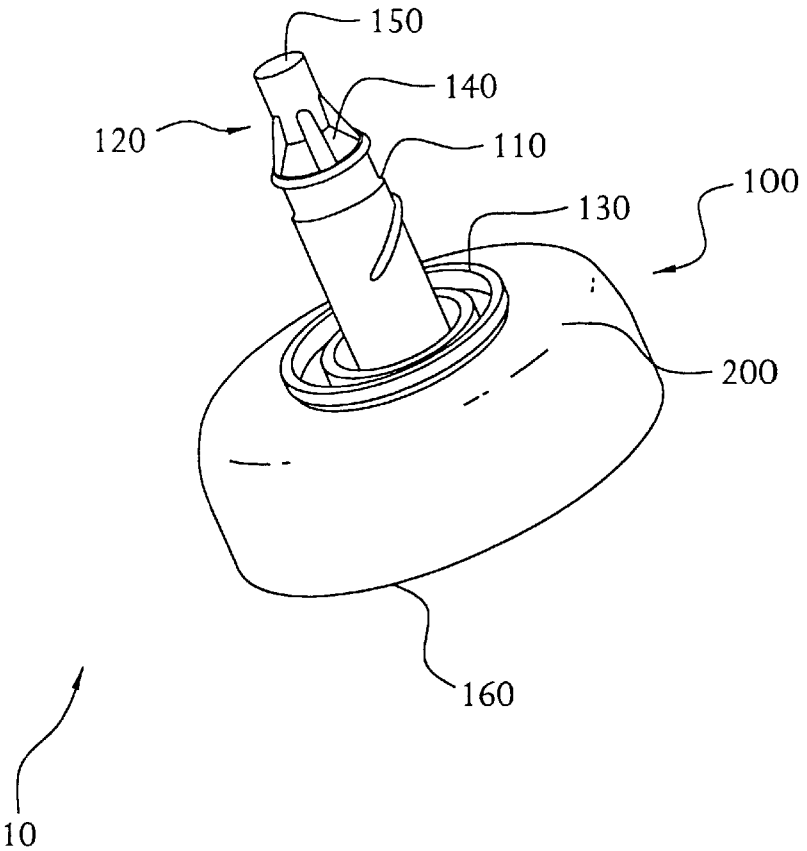
FIG. 1B is a perspective view of an exemplary embodiment of a base cap of a container cap dispensing apparatus.
Figure 1A:
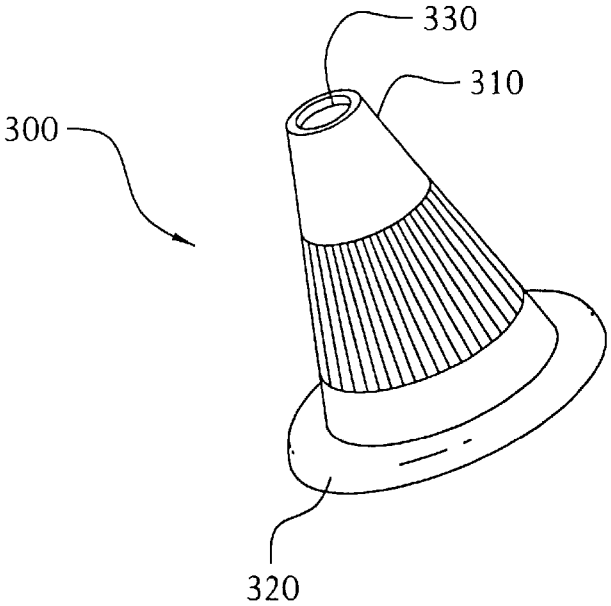
FIG. 1A is a perspective view of an exemplary embodiment of a cover cap of a container cap dispensing apparatus.

FIG. 1A is a perspective view of a cover cap 300 of a preferred embodiment of container cap dispensing apparatus 10 of this invention. A dispensing opening 330 is located at a top end 310 of the cover cap 300. A bottom end 320 is located opposite the top end 310.

FIG. 1B is a perspective view of a preferred base cap 100 of the above-mentioned container cap dispensing apparatus embodiment 10. The base cap 100 has a tubular body portion 110 having a top end 120 and a bottom end 130. The tubular body portion 110 has a discharge opening 140 preferably located between the bottom end 130 and the top end 120. The discharge opening 140 should be adequately sized to facilitate a smooth discharge of the contents upon squeezing or inverting a container secured to the container cap dispensing apparatus 10. For example, a discharge opening 140 for allowing a fluid such as water to be discharged need not be sized as large as a discharge opening 140 for allowing a semi-solid such as mustard to be discharged. The discharge opening 140 may be a single opening or arranged in various other configurations such as the web configuration shown in FIG. 1 and FIG. 2A.

Figure 6:
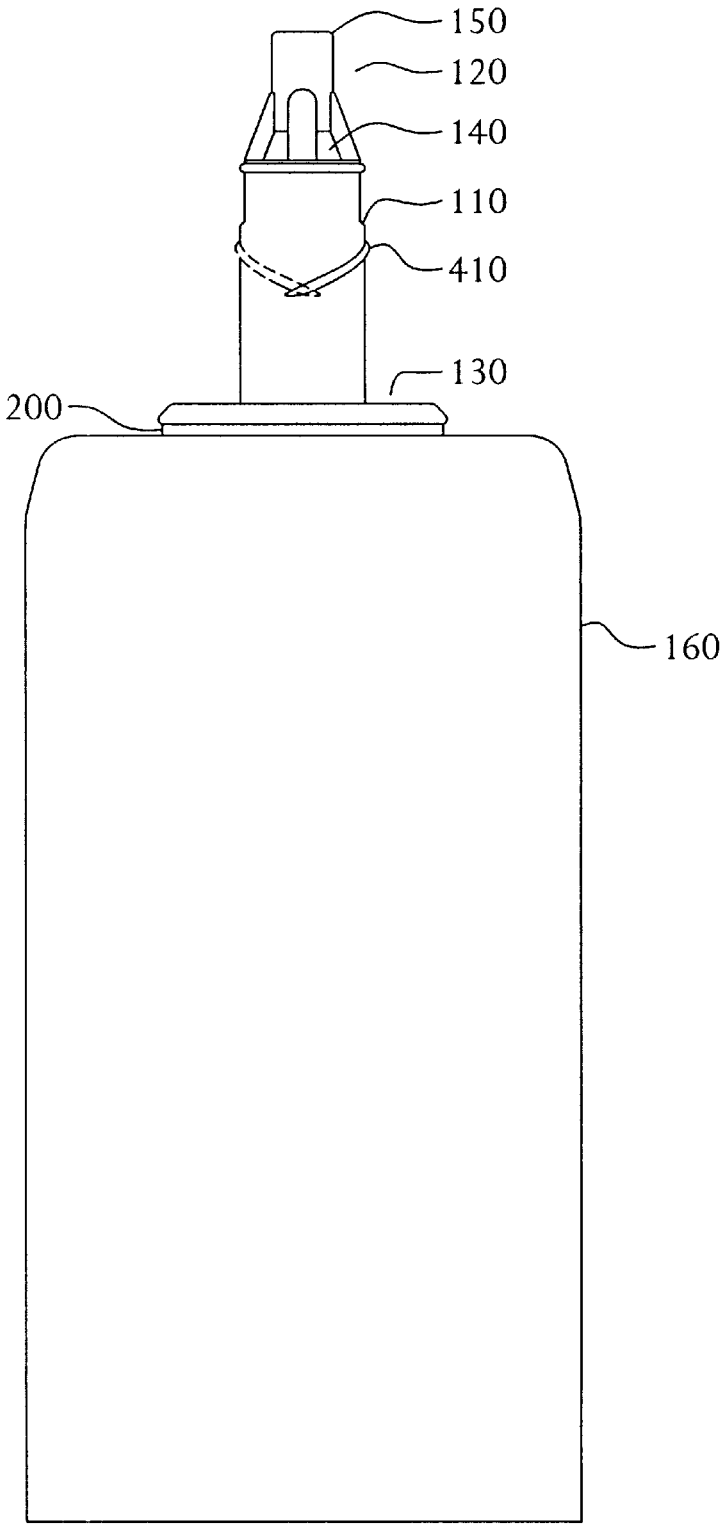
FIG. 6 is a side elevational view of an exemplary embodiment of a base cap of a container cap dispensing apparatus where the base cap forms into a container.

A plug 150 is preferably located near the top end 120 of tubular body portion 110. The dispensing opening 330 of cover cap 300 is sized to selectively accept the plug 150 of the base cap 100. The base cap 100 also comprises a base portion 160 located near the bottom end 130 of the tubular body portion 110. The base portion 160 is attached to a container (not shown) in order to secure the base cap 100 and the container cap dispensing apparatus 10 to the container. The base portion 160 may be secured by any means, such as by a set of cooperable screw threads disposed on the base portion 160 and the container. Several other methods of securing the base portion 160 to the container are also acceptable, such as through an interference fit, a snap fit, an adhesive fit, and the like. Conversely, referring to FIG. 6, the base portion 160 can be extended, such as by comolding, to form a portion of the container.

Figure 2B:
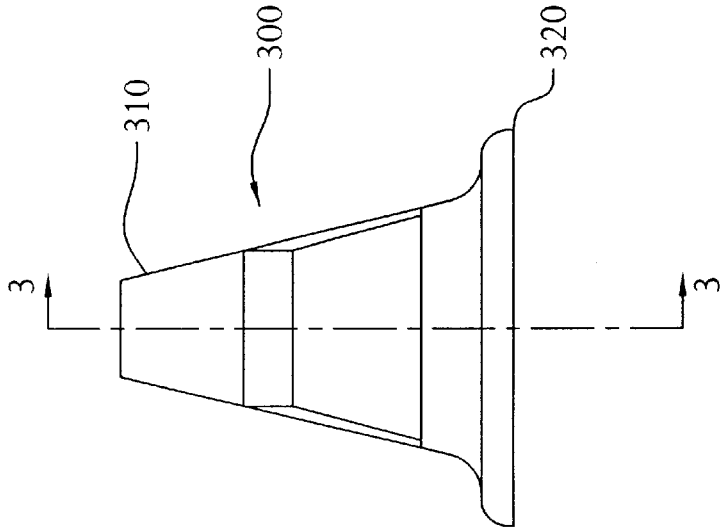
FIG. 2B is a side elevational view of an exemplary embodiment of a cover cap of a container cap dispensing apparatus.
Figure 2A:
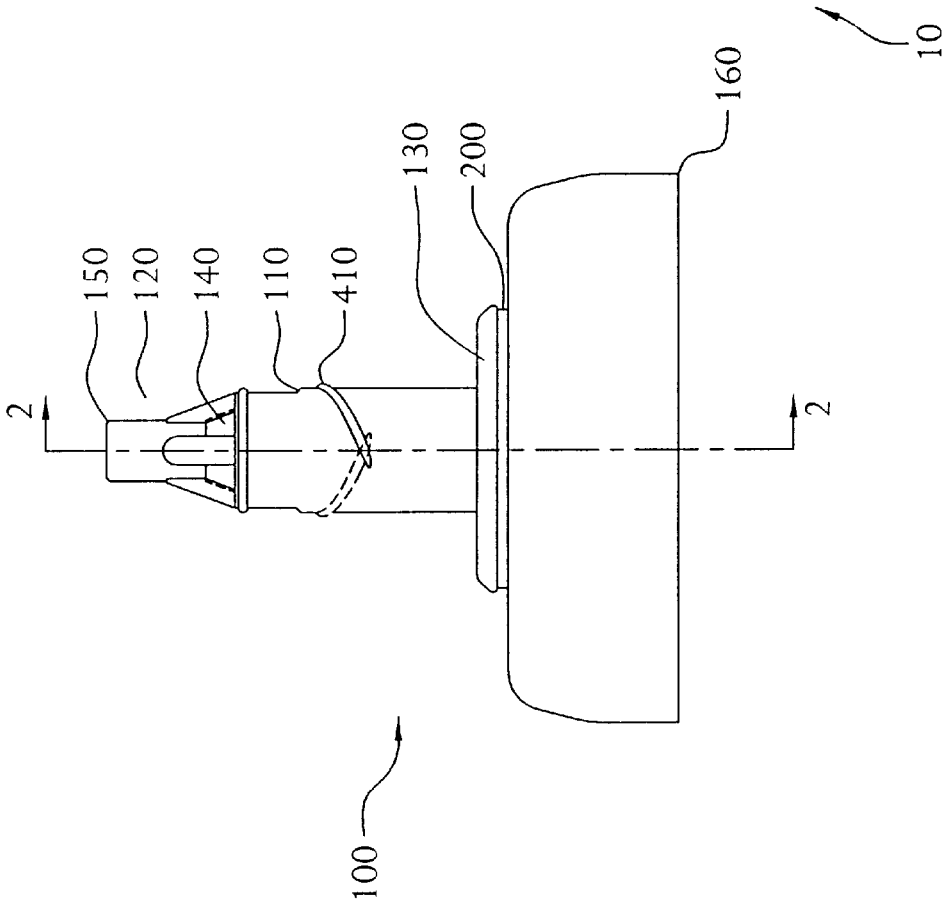
FIG. 2A is a side elevational view of an exemplary embodiment of a base cap of a container cap dispensing apparatus.
Figure 3B:
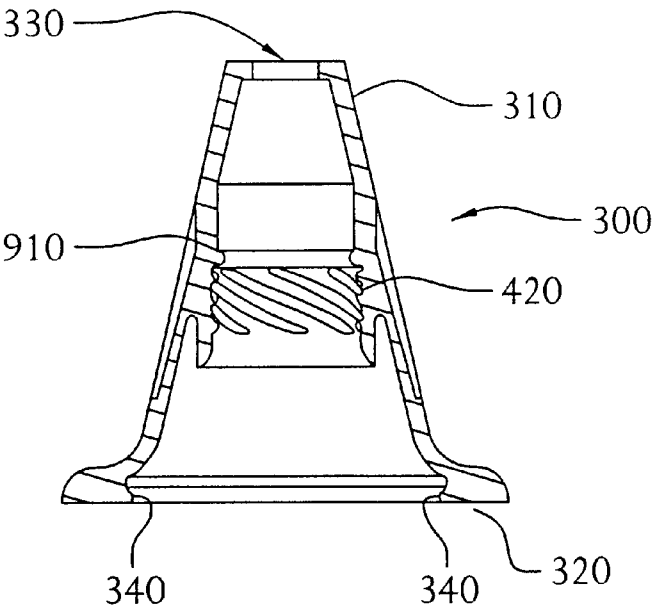
FIG. 3B is a cross-sectional view taken along line 3—3 of the cover cap of FIG. 2B.
Figure 3A:
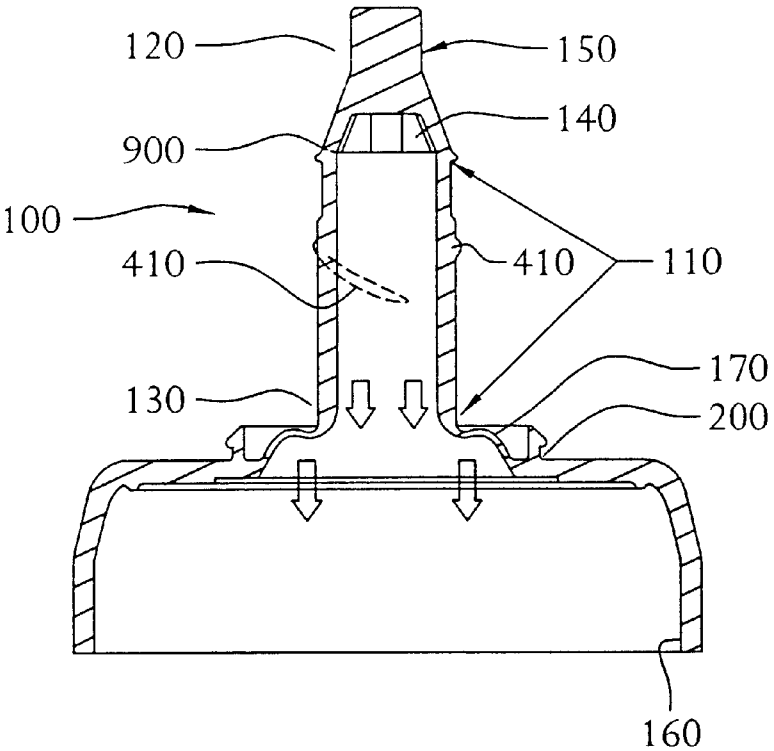
FIG. 3A is a cross-sectional view taken along line 2—2 of the base cap of FIG. 2A.
Figure 5B:
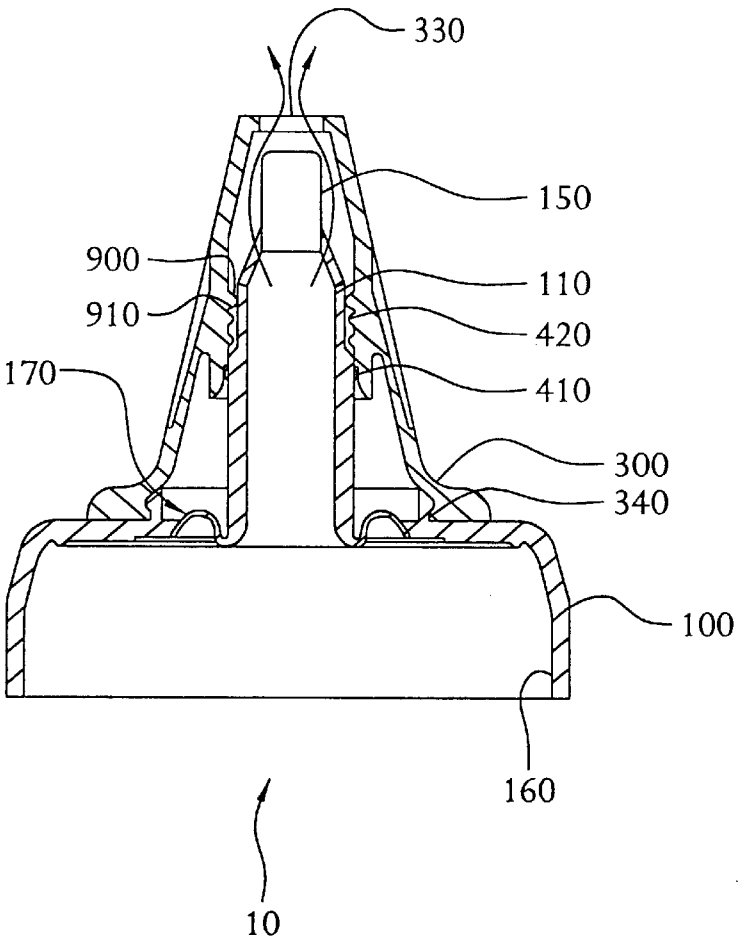
FIG. 5B is a cross-sectional view taken along line 4—4 of the assembled cap dispensing apparatus of FIG. 4 in the open position.
Figure 5A:
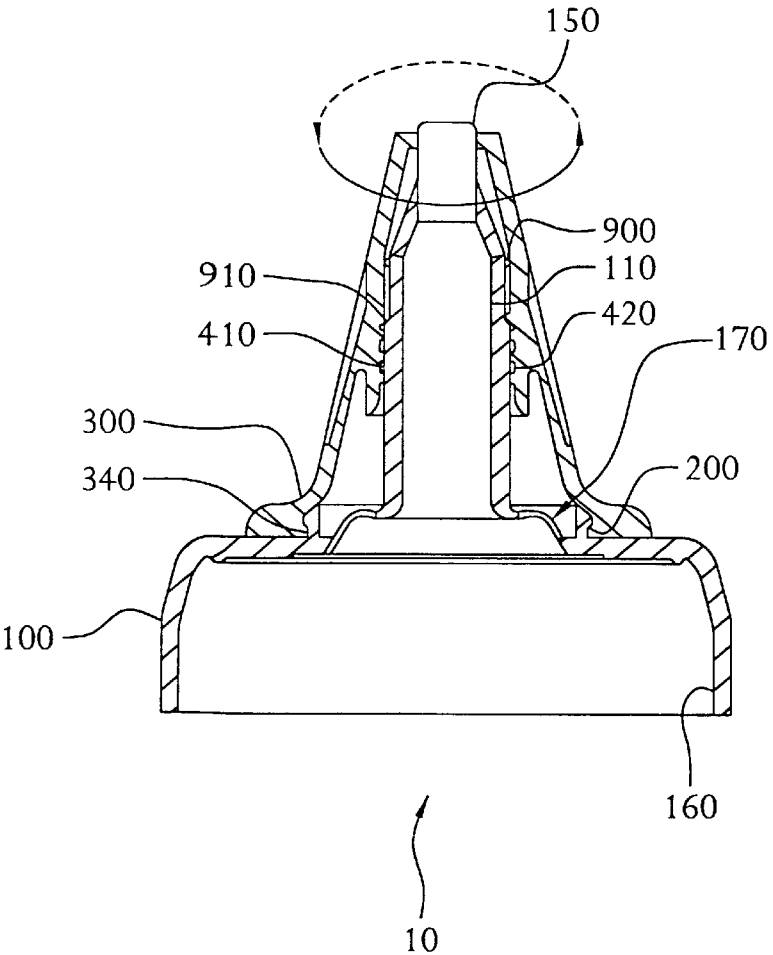
FIG. 5A is a cross-sectional view taken along line 4—4 of the assembled container cap dispensing apparatus of FIG. 4 in the closed position.

FIGS. 2A and 2B are side elevational views, respectively, of the base cap 100 of FIG. 1B and the cover cap 300 of FIG. 1A. FIG. 3A is a cross-sectional view of the base cap 100 of FIG. 2A taken along line 2—2. Similarly, FIG. 3B is a cross-sectional view of the cover cap 300 of FIG. 2B taken along line 3—3. Referring to FIGS. 1B, 2A, 3A, and 5A, the cover cap 300 and base cap 100 include comparable joining means which may include an annular groove and annular rib that allow the cover cap 300 to be swivally mounted relative to the base cap 100. The base cap 100 may include an annular groove 200 formed on base portion 160 of the base cap. The annular groove 200 is sized and positioned to swivally mount secure the cover cap 300 to the base portion 160. The cover cap 300 is desirably secured to the annular groove 200 in a preferred fluid-tight or contents-tight manner while permitting the cover cap 300 to rotate along the annular groove 200 of the base cap 100 when the cover cap 300 is disposed over a portion of the base cap 100 and rotated relative to the container (FIG. 5A and FIG. 5B). For example, the cover cap 300 may be secured by a protrusion or annular rib 340, as is shown in FIG. 3B, that effectively restricts the cover cap 300 from moving axially relative to the container (i.e., the cover cap remains in the same plane) but still permits the cover cap 300 to rotate along the annular groove 200.

Figure 7A:
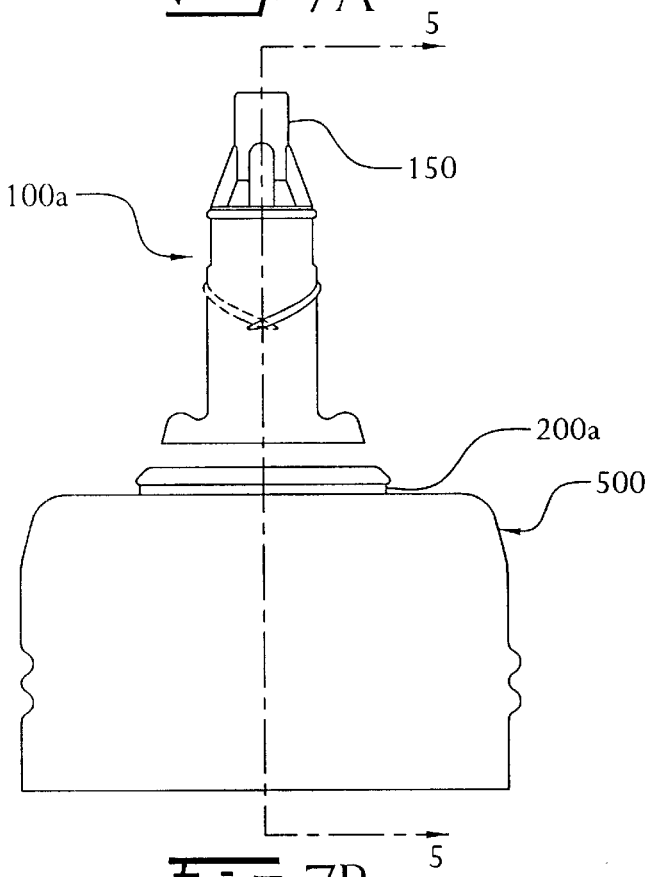
FIG. 7A is an exploded side elevational view of an exemplary embodiment of a base cap and container of a container cap dispensing apparatus.
Figure 7B:
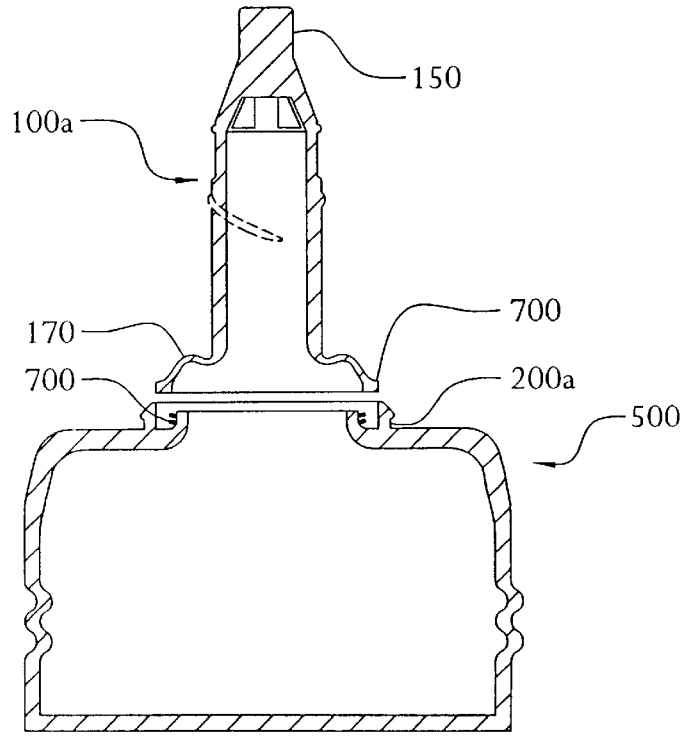
FIG. 7B is a cross-sectional view taken along line 5—5 of the base cap and container of FIG. 7A.

The annular rib 340 may be a series of spaced protrusions or a continuous or semi-continuous annular protrusion, or the like. Alternatively, the location of the annular rib 340 and groove 200 may be reversed, so that the cover cap 300 includes the annular groove and the base cap 100 includes the annular rib, or the like. Similarly, referring to FIGS. 7A and 7B, the container 500 may include an annular groove 200*a* for cooperating with a mating surface on the cover cap 300, e.g., annular rib 340, or the container may include an annular rib and the cover cap may include an annular groove. In this embodiment, the cover cap 300 is swivally mounted to the container and can still rotate relative to the base cap 100 but will not move axially relative to the container 500 or base cap 100. Also, as shown in FIGS. 7A and 7B, the base cap is secured to the container 500 in a conventional manner, such as by a cooperable thread means 700.

The base cap 100 also includes a flexible support, such as spokes or a membrane 170, which can be continuous or contain openings for passing contents of an attached container.

If the flexible support contains openings in this fashion, the discharge opening 140 becomes an optional feature. See for example, the embodiment of FIGS. 8A, 8B, and 9 discussed below.

The flexible membrane 170 may preferably have a thickness ranging from approximately 5 to 10 thousandths of an inch so that it is sufficiently flexible to allow tubular body 110 to move in the direction indicated by the directional arrows of FIG. 3A. In one embodiment of the container cap dispensing apparatus, the flexible membrane 170 may comprise a pleat or series of pleats formed in, for example, an accordion shape to facilitate flexibility. The pleat embodiment affords the added advantage of providing flexibility for the flexible support at the pleat location independent of the thickness of the flexible support. The pleats, therefore, allow for greater thickness tolerances when forming the flexible support. If the flexible membrane includes pleats, the flexible membrane thickness may vary between approximately 5 and 100 thousandths of an inch. If the flexible membrane 170 is constructed from thermoplastics such as polyethylene or polystyrene, a flexible membrane including pleats more preferably has a thickness between 5 and 20 thousandths of an inch in order to facilitate smooth movement of the tubular body 110.

The displacement of flexible membrane 170 permits the tubular body portion 110, and thereby the plug 150, of the base cap 100 to move axially within the cover cap 300 of assembled container cap dispensing apparatus 10 as shown in FIGS. 5A and 5B. The cooperable joining means of the base cap 100 and the cover cap 300 includes cooperable thread means 410,420 as shown in FIGS. 3A and 3B. The cooperation between the cover cap 300 and the base cap 100 in accomplishing the displacement of flexible membrane 170 is explained hereafter.

Figure 8A:
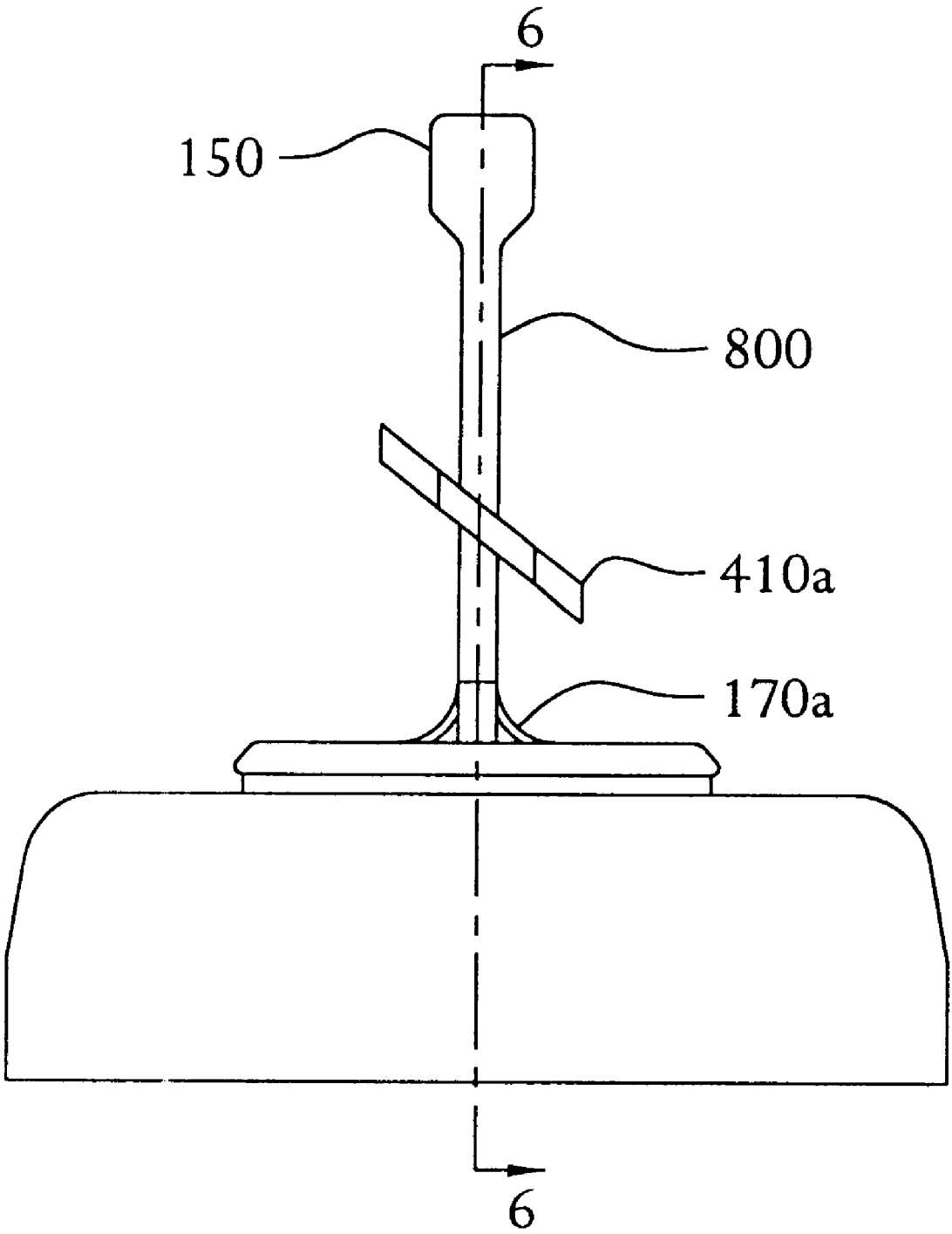
FIG. 8A is a side elevational view of an exemplary alternative embodiment of a base cap of a container cap dispensing apparatus.
Figure 8B:
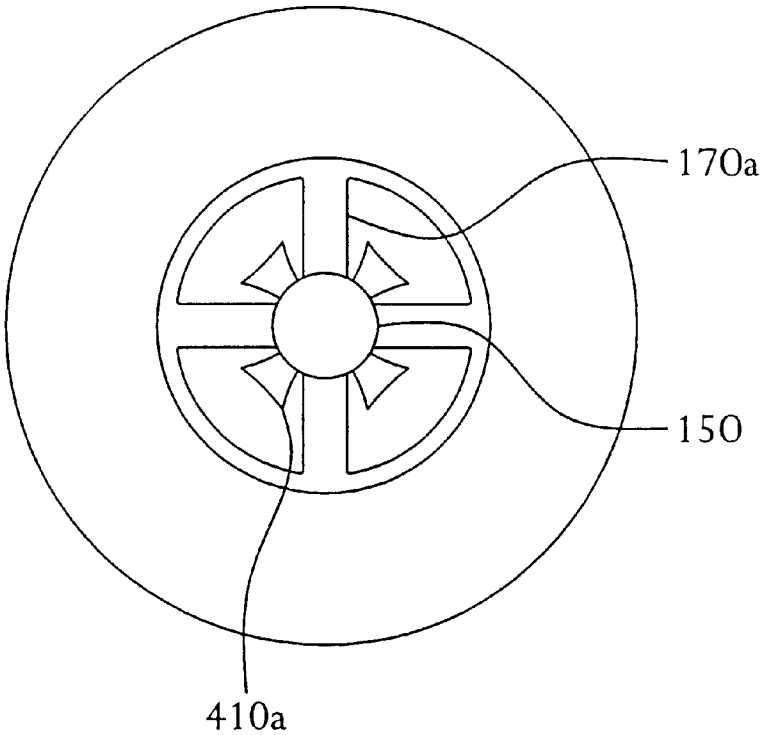
FIG. 8B is a top plan view of the base cap of FIG. 8A.
Figure 9:
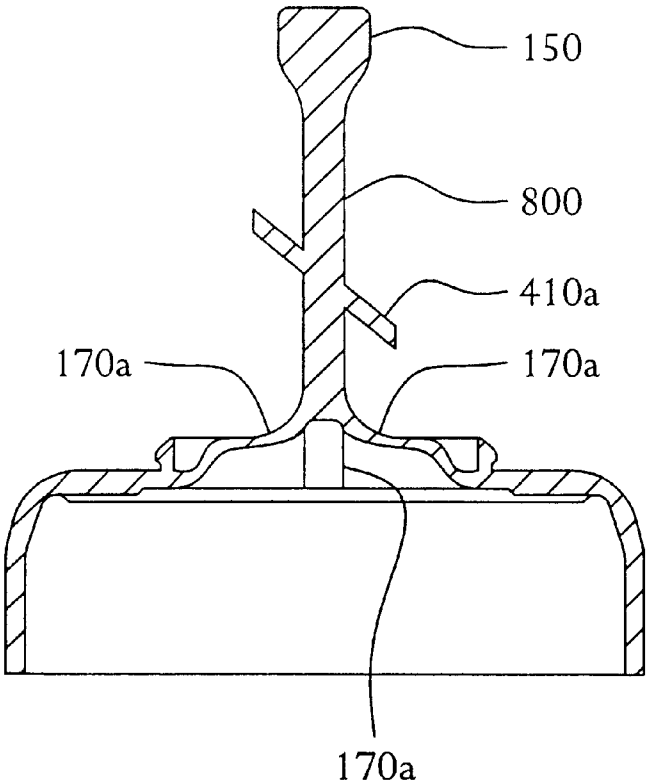
FIG. 9 is a cross-sectional view taken along line 6—6 of the base cap of FIG. 8A.

In an alternative embodiment of the invention shown in FIGS. 8A, 8B, and 9, the tubular body portion of base cap 100 is replaced with a solid plug supporting member 800 having at least one lateral portion for engaging the cover cap 300. In one example, the solid plug supporting member 800 includes a male thread 410*a* for engaging with the preferred female thread 420 of the cover cap 300 to permit axial displacement of the solid plug supporting member 800, plug 150, and flexible membrane spokes 170*a* upon rotation of the cover cap 300.

Figure 4:
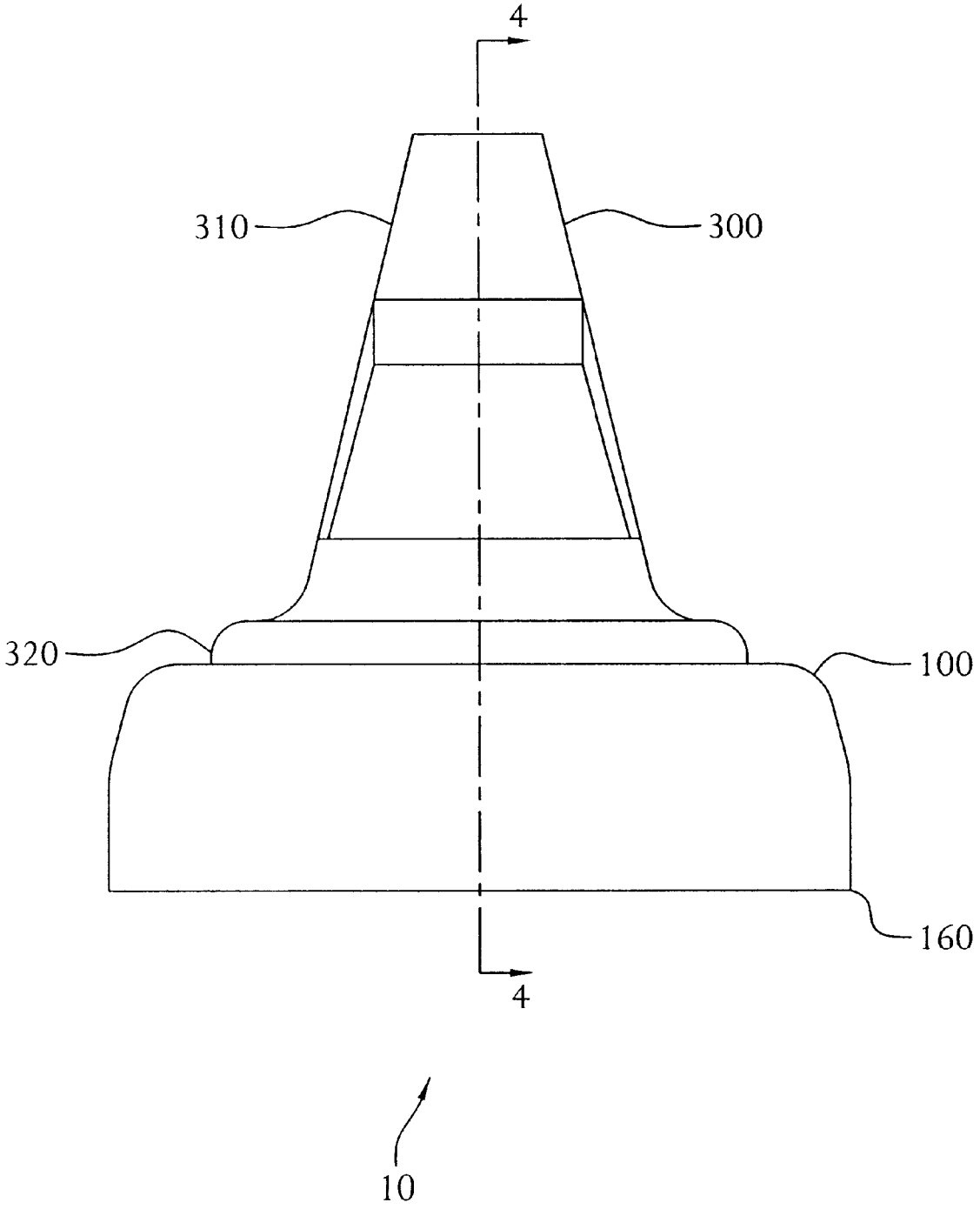
FIG. 4 is a side elevational view of an exemplary embodiment of an assembled container cap dispensing apparatus.

FIG. 4 shows an assembled container cap dispensing apparatus 10, and FIGS. 5A and 5B show a cross-sectional view of container cap dispensing apparatus 10 taken along line 4—4 of FIG. 4. As can be seen in FIGS. 5A and 5B, the cover cap 300 is secured in the annular groove 200 by annular rib 340. This configuration permits cover cap 300 to rotate along the annular groove 200 as shown by the directional arrows of FIG. 5A. FIG. 5A shows the container cap dispensing apparatus 10 in a "closed" position, i.e., the plug 150 occupies the dispensing opening 330. As the cover cap 300 is rotated counter-clockwise relative to a container secured to the base portion 160 of base cap 100, the cooperation between the thread-groove combination 410, 420 of the cooperable thread means acts to drive the plug 150 and tubular body portion 110 away from the dispensing opening 330 and into the "open" position depicted in FIG. 5B. The cover cap 300 is permitted to rotate in annular groove 200 but is fixed axially relative to the container, thereby insuring that the tubular body portion 110 is axially displaced, and not the cover cap 300, when the cover cap 300 is rotated. The displacement of flexible membrane 170 from its extended position in FIG. 5A to its constricted position in FIG. 5B allows the progression of container cap dispensing apparatus 10 from the "closed" position to the "open" position. In order to return the apparatus 10 from the "open" position to the "closed" position, the cover cap 300 is rotated clockwise. The thread-groove combination 410, 420, the rotation of the cover cap 300 in annular groove 200, and the flexible membrane 170 all cooperate to move the plug 150 into the dispensing opening 330, thereby closing the container cap dispensing apparatus 10.

When the container cap dispensing apparatus 10 is in the "open" position of FIG. 5B, contents from the container are permitted to flow in the direction indicated by the directional arrows through the tubular body portion 110 and discharge opening 140 and out dispensing opening 330. Conversely, when the cover cap dispensing apparatus 10 is in the "closed" position of FIG. 5A, discharge of the contents of the container is impeded by the plug 150 occupying dispensing opening 330.

FIGS. 3A, 3B, 5A and 5B also show protrusions 900 and 910. These protrusions may be annular or either protrusion 900 or 910 may be a bead or plurality of beads, thereby allowing the cover cap 300 to snap fit to the base cap 100. The protrusions may also be continuous to prevent product from entering the thread-groove combination 410,420.

Figure 10:
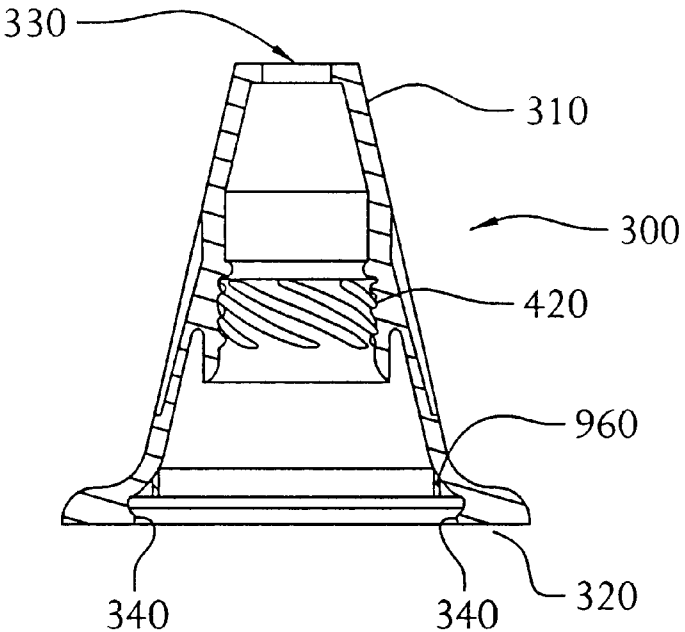
FIG. 10 is a cross-sectional view of an exemplary alternative embodiment of a cover cap of a container cap dispensing apparatus.
Figure 9A:
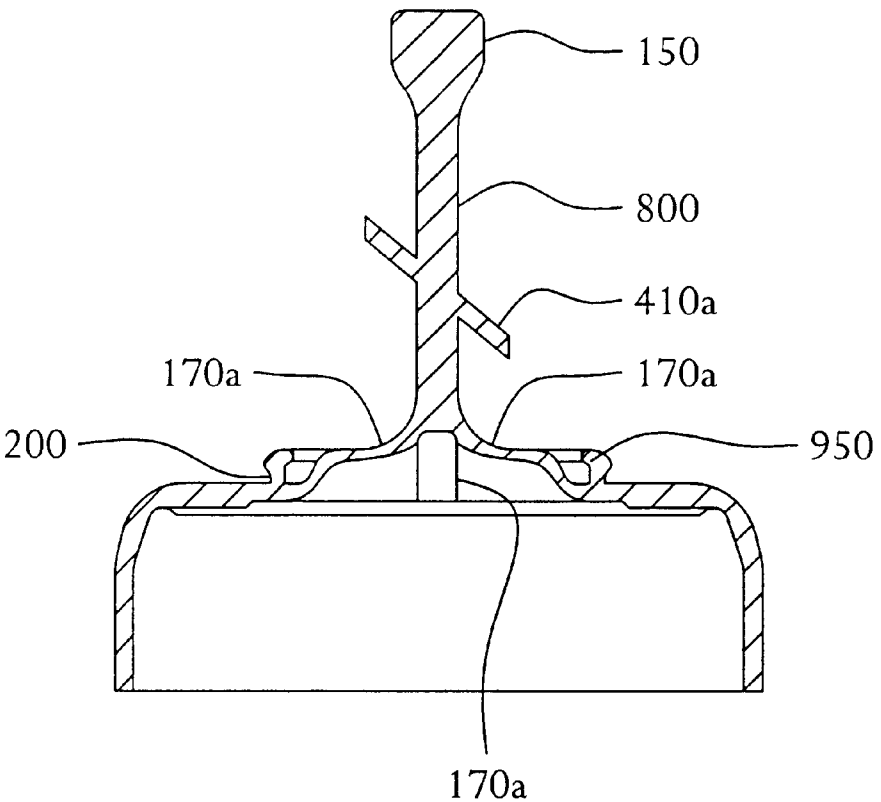
FIG. 9A is a cross-sectional view of an exemplary alternative embodiment of a base cap of a container cap dispensing apparatus.

FIG. 9A shows an exemplary embodiment of the base cap 800 of FIG. 9 with annular sealing rib 950. FIG. 10 shows an exemplary embodiment of the cover cap 300 with annular sealing protrusion 960. Rib 950 and protrusion 960 cooperate together to prevent the unwanted discharge of product from the assembled container cap dispensing apparatus 10 into the annular groove 200.

The flexible membrane 170 also acts to restrict the range of rotation of the cover cap 300 along annular groove 200. When the cover cap 300 is rotated in the clockwise direction to close the container cap dispensing apparatus 10, the length of the flexible membrane 170 acts to limit the range that the cover cap 300 can be rotated. The cover cap 300 can only be rotated clockwise until the flexible membrane 170 reaches its full extended length. The design also alleviates the need for lugs to limit the range of rotation for the cover cap in the counter-clockwise opening direction. The angled grooves 420 of cover cap 300 may be disposed as a series of parallel grooves spaced such that when the thread 410 of base cap 100 reaches the end of a groove 420 when the cover cap 300 is rotated in the counter-clockwise direction, as shown in FIG. 5B, the thread 410 skips to the next parallel groove 420. The cover cap 300, therefore, can be continually rotated in the counter-clockwise direction without the tubular body portion 110 moving axially further than permitted by the length of any one groove 420. Since the thread-groove combination 410,420 of the base cap 100 and cover cap 300 are preferably continuously engaged and the cover cap 300 is secured in annular groove 200, no lugs are required to limit the cover cap's counter-clockwise rotation.

From the "open" position, the cover cap dispensing apparatus 10 can again be closed simply by rotating the cover cap 300 in the clockwise direction until the flexible membrane 170 is fully extended.

The above-described cover cap dispensing apparatus 10 may be created using conventional molding techniques for thermoplastics. The cover cap dispensing apparatus 10 may be molded out of any acceptable thermoplastic such as polystyrene, polyurethane, polycarbonate, polyethylene, polymethylpentene, or polypropylene.

Figure 11:
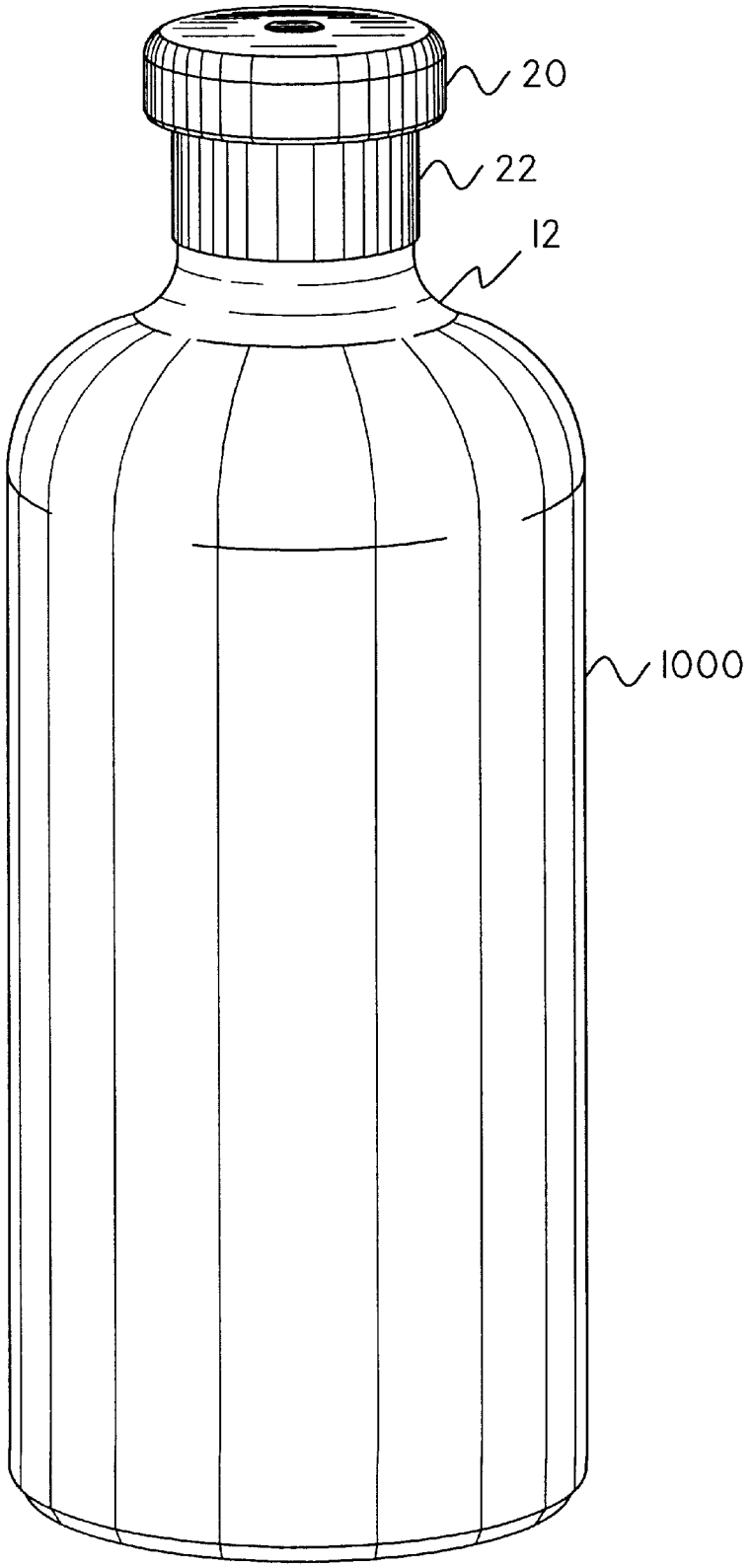
FIG. 11 is a perspective view of another exemplary embodiment of a container closure assembly including a container cap dispensing apparatus in accordance with the present invention.
Figure 12:
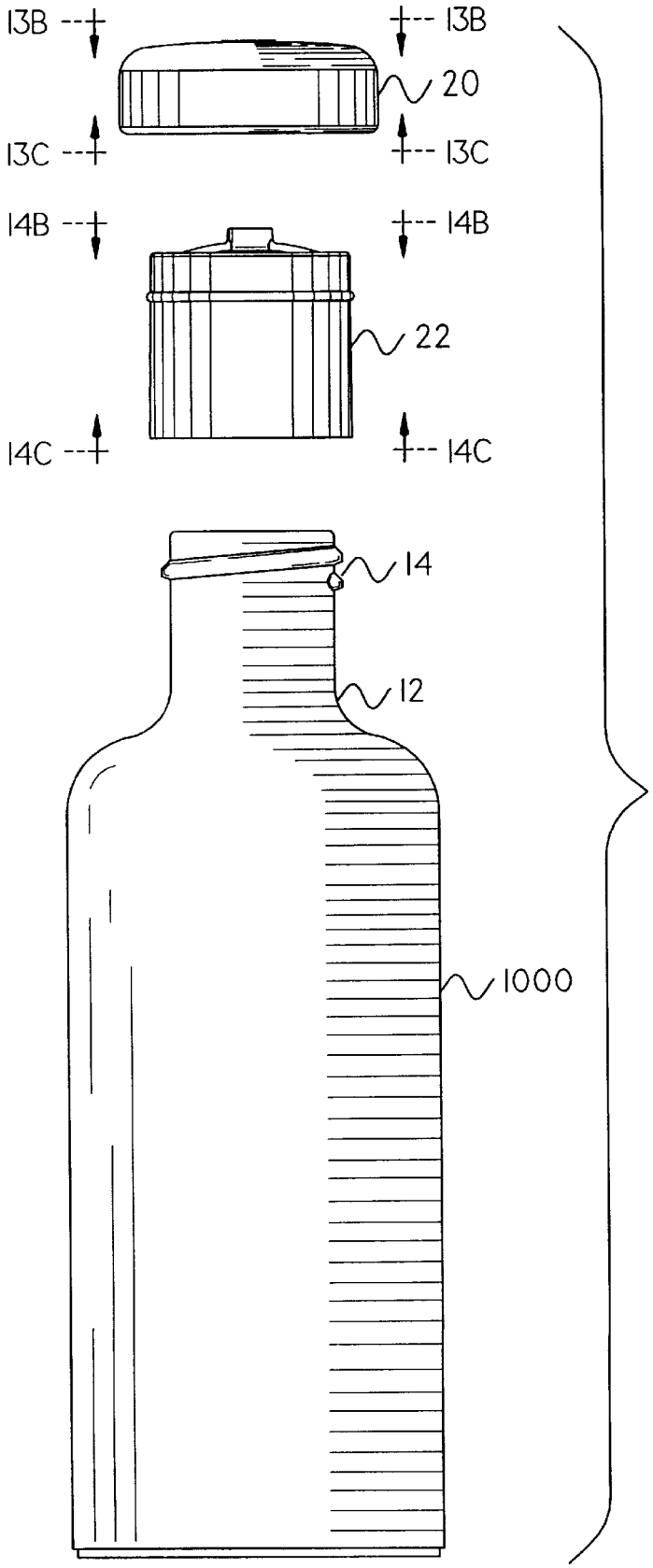
FIG. 12 is an exploded side elevational view showing the major components of the container closure assembly of FIG. 11.

Referring now to the FIGS. 11–20, and particularly to FIGS. 11 and 12 thereof, there is shown a container closure assembly incorporating features of an exemplary embodiment of a container cap dispensing apparatus according to the present invention. The container 1000 is a typical bottle-type container for liquid products and may be made of a plastic material by blow molding. The container 1000 has the usually reduced neck finish 12 having external spiral threads 14.

Figure 13A:
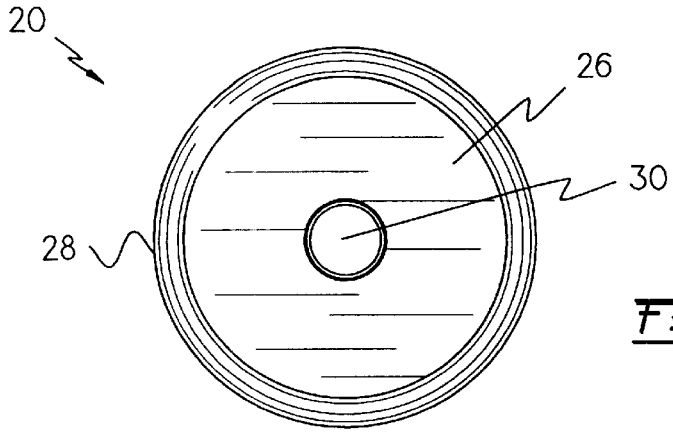
FIG. 13A is a top plan view of an exemplary cap member according to the present invention.
Figure 13B:
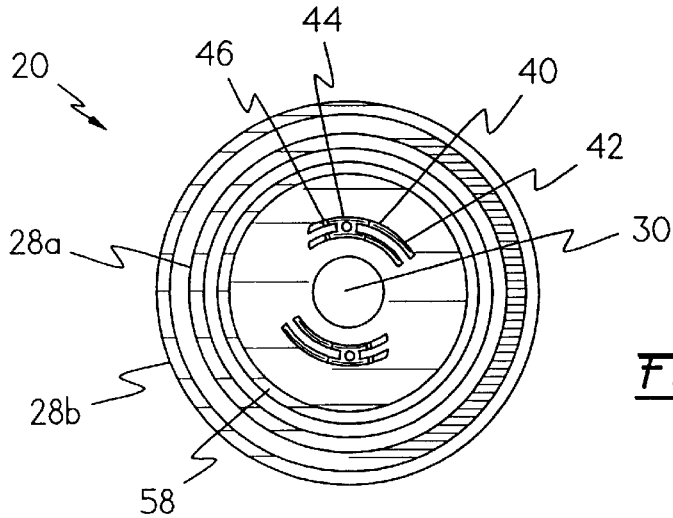
FIG. 13B is a bottom plan view of the cap member shown in FIG. 13A.
Figure 13C:
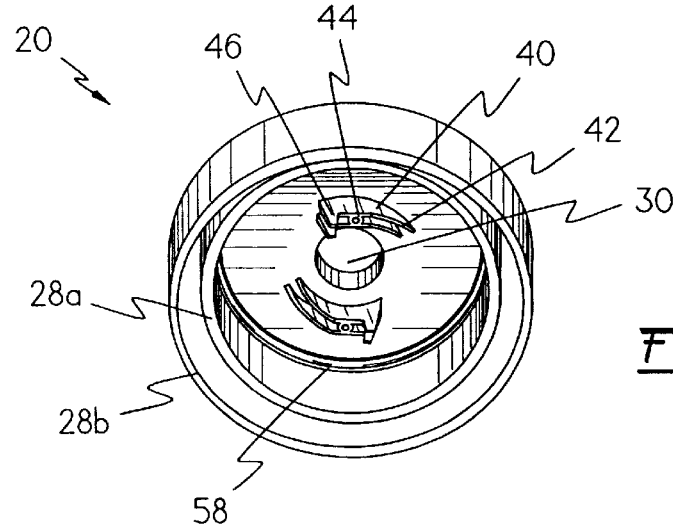
FIG. 13C is a perspective view showing the cam elements of the cap member on the underside of the top of the cap member.
Figure 14A:
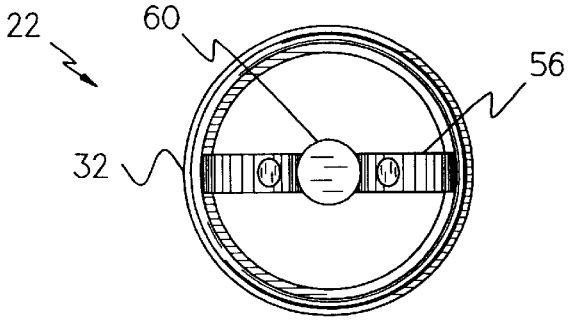
FIG. 14A is a top plan view of an exemplary toggle sleeve member according to the present invention.
Figure 14B:
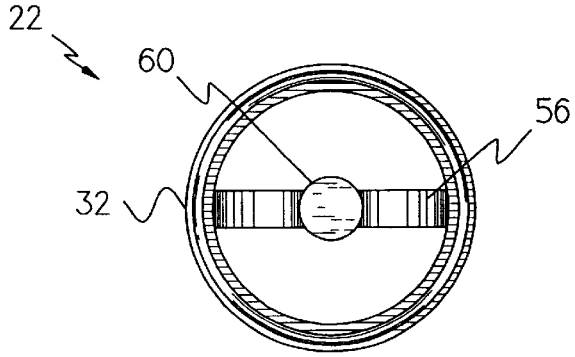
FIG. 14B is a bottom plan view of the toggle sleeve member.
Figure 14C:
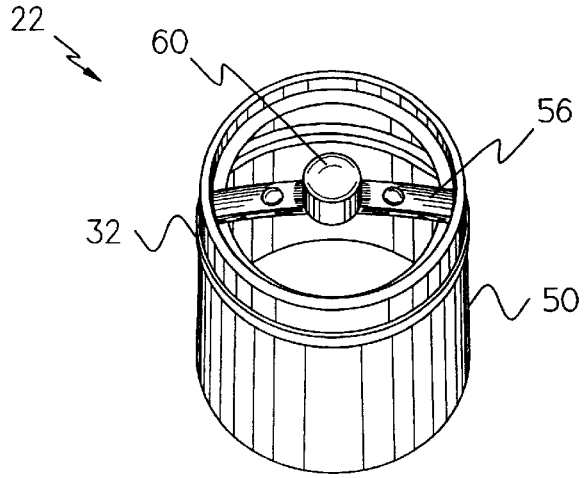
FIG. 14C is a perspective view of the toggle sleeve member.
Figure 14D:
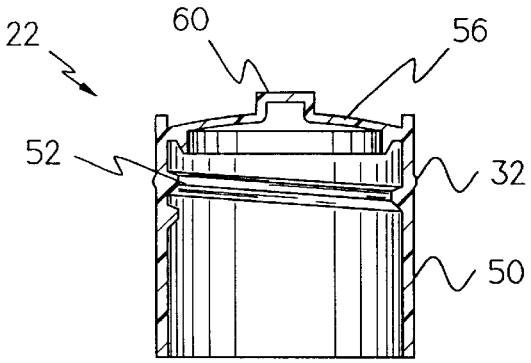
FIG. 14D is a side plan, cross-sectional view of the toggle sleeve member of FIGS. 14A–14C.

The container cap dispensing apparatus in the present instance comprises a cap member 20 and an elongated generally cylindrical toggle sleeve member 22. The cap member 20, as shown in FIGS. 13A–13C is of generally cup-like form having a generally disc-like top 26, and a depending skirt 28 of inverted U-shape cross section. A discharge opening 30 is provided centrally in the top 26 of the cap member 20. An exemplary skirt 28 of the cap in the present instance may comprise inner and outer skirt portions $\mathbf{28}_a$, $\mathbf{28}_b$ radially spaced apart. Referring to FIG. 15*c*, the cap member 20 snap fits up over the upper end of the toggle sleeve member 22 and is retained in that position by a protrusion, such as radially outwardly circumferentially extending rib 32, on the exterior surface of the toggle sleeve member 22 spaced downwardly from the top. The rib 32 snap fits into a circumferentially extending groove 34 on the inner face of the inner skirt portion $\mathbf{28}_a$. Alternatively, the toggle sleeve member 22 may include the circumferentially extending groove and the cap member 20 may include the circumferentially extending rib. In the present instance, a pair of diametrically opposed depending cams 40 project downwardly from the inner face of the top 26 of the cap member 20. The cam surface preferably includes an inclined ramp 42, a flat 44, and a stop 46.

Figure 15A:
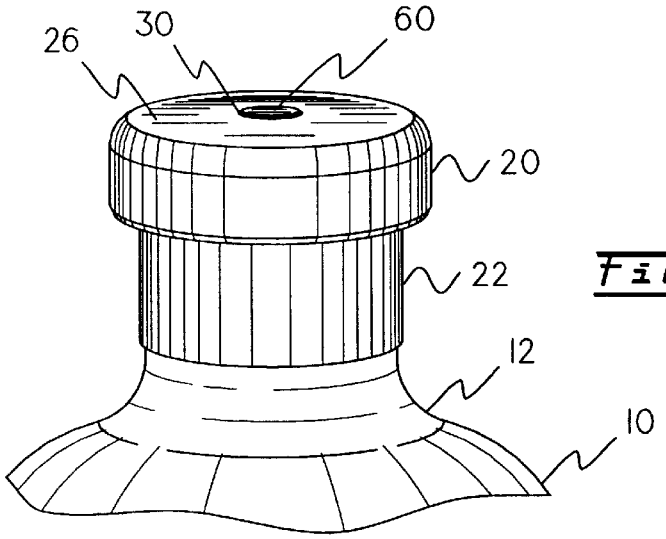
FIG. 15A is a perspective view of an assembled container cap dispensing apparatus in a closed position secured to a container.
Figure 15B:
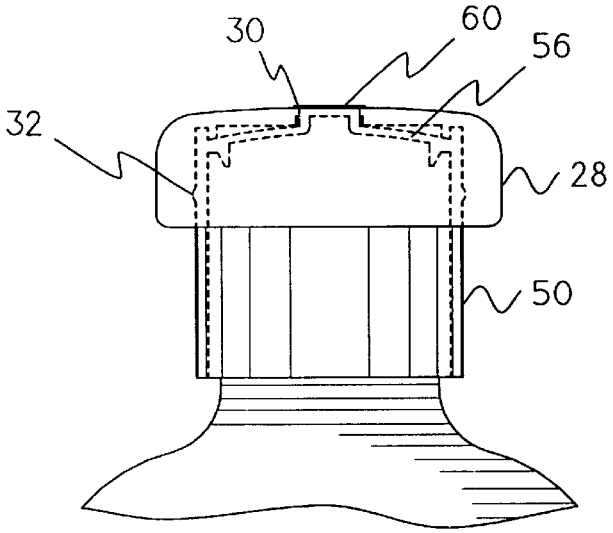
FIG. 15B is a side elevational view of the assembled container cap dispensing apparatus of FIG. 15A.
Figure 15C:
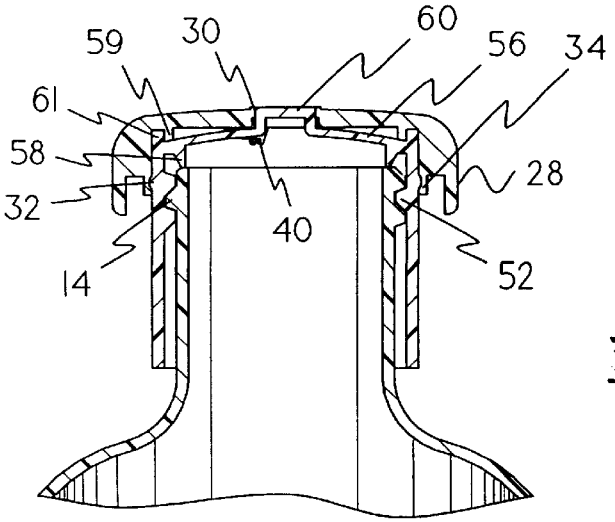
FIG. 15C is a cross-sectional view showing the parts of the assembled container cap dispensing apparatus in a closed or sealed position.
Figure 16A:
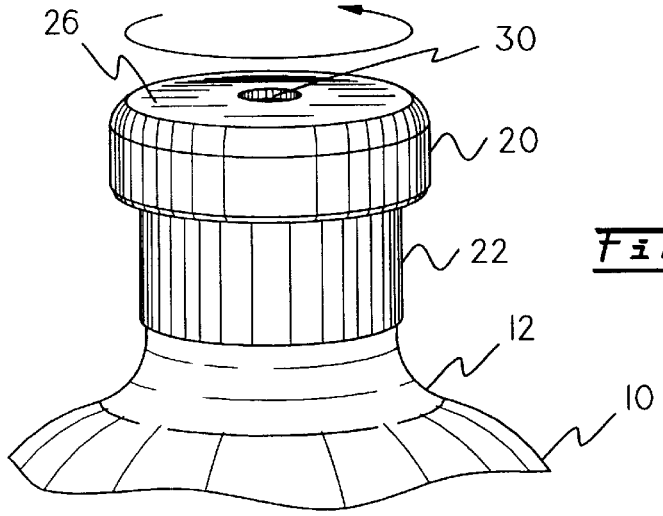
FIG. 16A is a perspective view showing the container cap dispensing apparatus rotated to an open position.
Figure 16B:
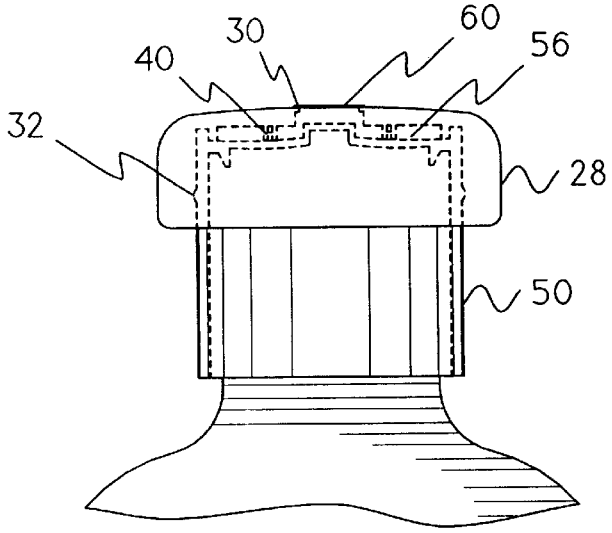
FIG. 16B is a side elevational view showing the respective position of the container cap dispensing apparatus in the open position.
Figure 16C:
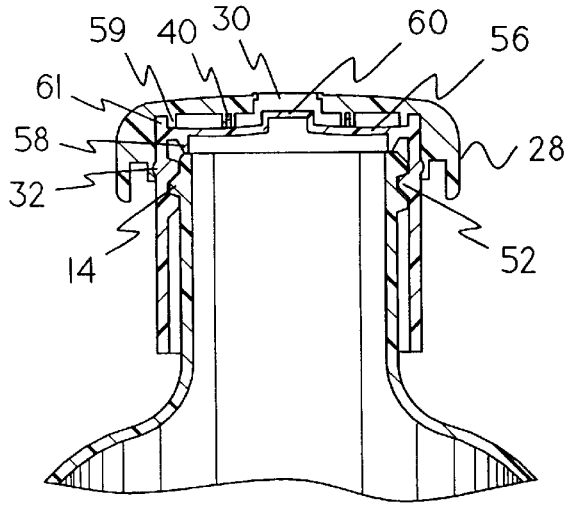
FIG. 16C is a cross-sectional view showing the elements of the container cap dispensing apparatus in a rotated open position to permit dispensing of products from the container.

The toggle sleeve member 22 is best illustrated in FIGS. 14A–D and includes an elongated tubular side wall or sleeve 50 having an internal spiral thread 52 which cooperates with the external threads 14 on the neck of the container 1000 so that the toggle sleeve member 22 and cap member 20 may be assembled and secured to the container 1000 simply by turning it in a clockwise direction, thereby seating the cap member 20 and sleeve member 22 in a closed sealed position as shown in FIGS. 15B and 15C.

The toggle sleeve member 22 includes has an upwardly bowed bridge strap 56 preferably disposed at its upper end and having a generally cylindrical button 60 disposed to seat in the discharge opening 21 to seal the discharge opening 21 in the manner shown in FIG. 15C. In the fully seated position of the toggle sleeve 22, a circumferentially extending, radially inwardly directed sealing rib 58 preferably engages the interior of the container 1000 to provide a seal preventing a liquid product from discharging except through the discharge opening 21. The cap member 20 may also have a depending sealing rib 59 which seats interiorly of an upstanding projection 61 on the toggle sleeve member 22.

In the sealed closed position, the ramps 42 of cams 40 are spaced to either side of the strap 56. When it is desired to activate the parts to permit discharge of fluid contents from the container 10, the cap 20 is rotated relative to toggle sleeve 22 in a counter-clockwise direction, whereby the ramp portions 42 of the cam surface engage the top of the strap 56 until the stop 46 abuts a side edge of the bridge strap 56. In this position, the closure button 60 is depressed downwardly to define a flow-path, as indicated by the directional arrows in FIG. 17D, around the button 60 and through the discharge opening 21 in the manner shown in FIG. 17D. When it is desired to re-close the container 10, the cap member 20 is simply rotated in a clockwise direction relative to the toggle sleeve member 22, whereby the cams 40 back off to a position displaced circumferentially from the bridge strap 56 and the normal flexure of the bridge strap 56 permits displacement of the button 60 upwardly to seal the discharge opening 21.

Figure 17A:
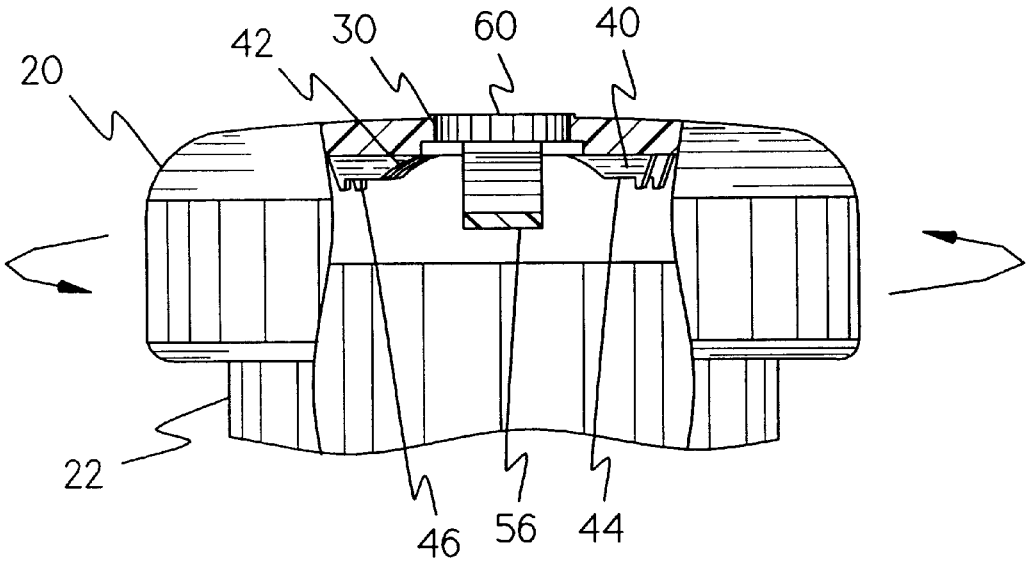
Figure 17B:
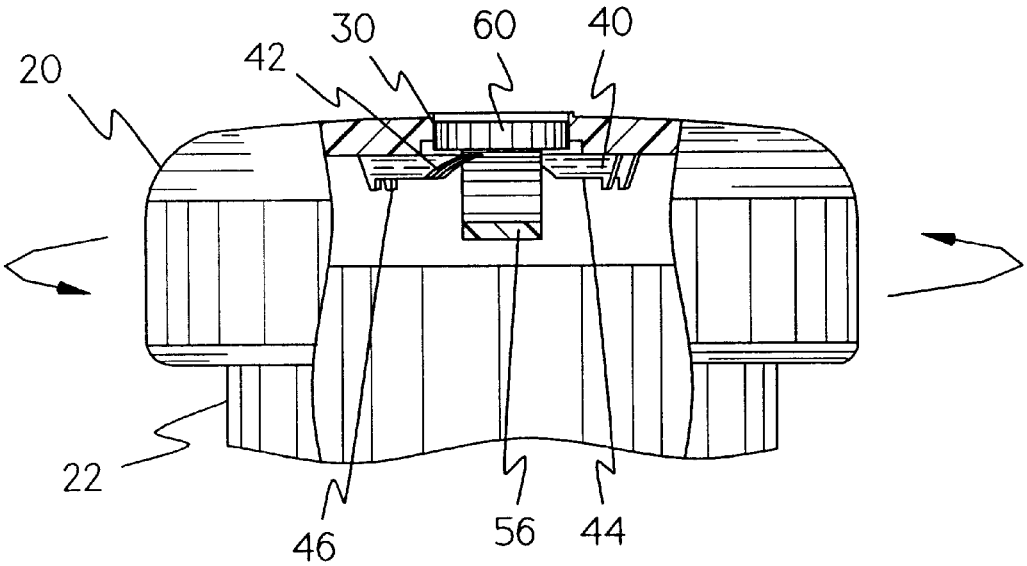

There is shown in FIGS. 18A–18D inclusive a modified cap member 20*b* for a container cap dispensing apparatus in accordance with the present invention. The structure of the cap 20*b*, which is similar to that described previously, has the same reference numerals as cap member 20 with the subscript "b." In this instance, the stops 48 depend from the top 26 of the cap member 20*b* to a depth to engage the strap 56 of an attached toggle sleeve member 22 when the cap has been rotated such that the container cap dispensing apparatus is in its fully closed position, such as shown in FIGS. 15C and 17A, to prevent discharge of contents from a container 1000. The cam 40*b* also includes stops 46*b* to further prevent the bridge strap 56 from continuing past the cam 40*b* when the apparatus is rotated to the open position. Also, stops 48 preferably extend toward the cam stops 46*b* to prevent a bridge strap 56 from seating in an area between the stop 48 and stop 46*b* if a bridge strap 56 is forced past a stop 46*b*. Further, the cam surface may include a flat area that is a cut out 44*b* defining a seat for the strap 56 in the fully open position and providing a positive lock of the strap 56 in that position Cams 40*b* of cap member 20*b* are oriented such that the container cap dispensing apparatus may be opened by rotating the cap member 20*b* in the conventional counter-clockwise manner. It should be apparent, though, that the cams may also be oriented such that the apparatus opens by rotating the cap member in a clockwise direction. If the cams 40*b* are disposed such that the apparatus is in the "open" position when the cap member 20*b* is rotated in the counter-clockwise manner, stops 48 provide the added feature of a robust protrusion that the bridge strap 56 may push against when the dispensing apparatus (the combined cap member 20*b* and toggle sleeve member 22) are rotated in the clockwise direction to secure the dispensing apparatus to a container 1000.

Figure 19A:
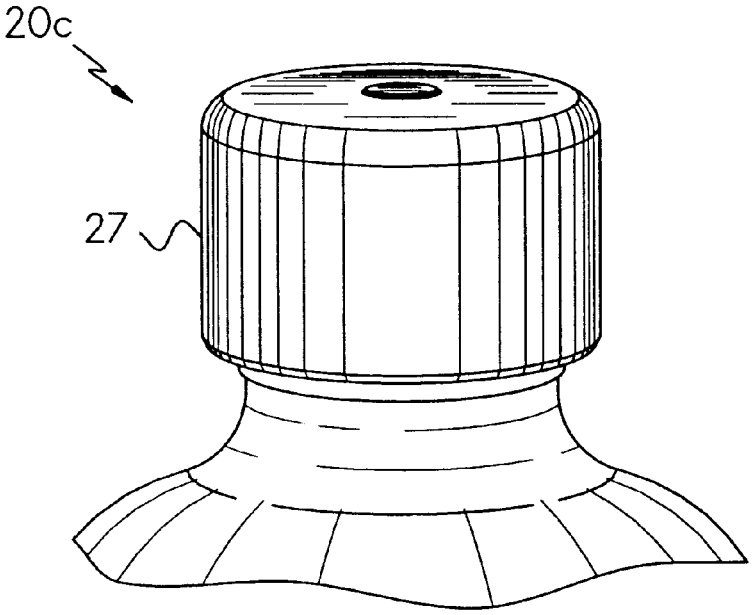
FIG. 19A is a perspective view of another embodiment of the container cap dispensing apparatus in accordance with the present invention.
Figure 19B:
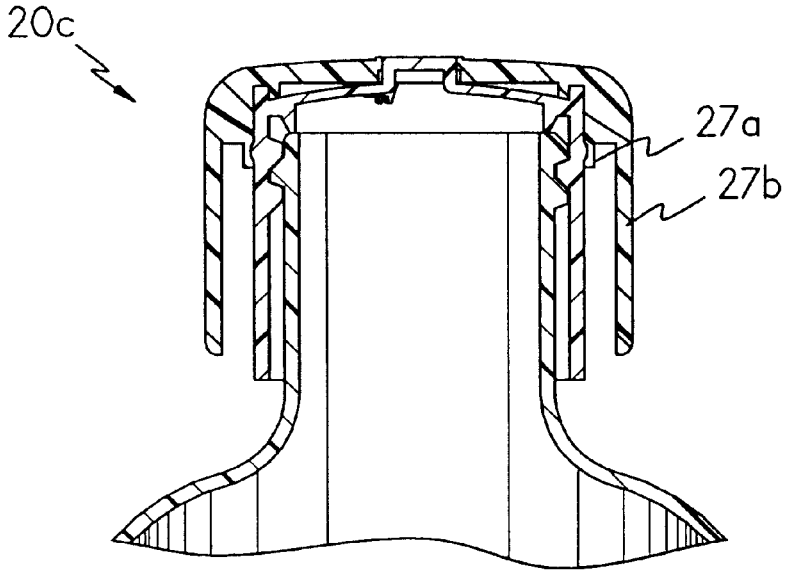
FIG. 19B is a cross-sectional view of the assembly shown in FIG. 19A.

FIGS. 19A and 19B illustrates another exemplary embodiment of the cap member in accordance with the present invention, wherein the outer skirt 27*b* of the cap 20*c* extends downwardly to a point almost aligned with the toggle sleeve.

Figure 20A:
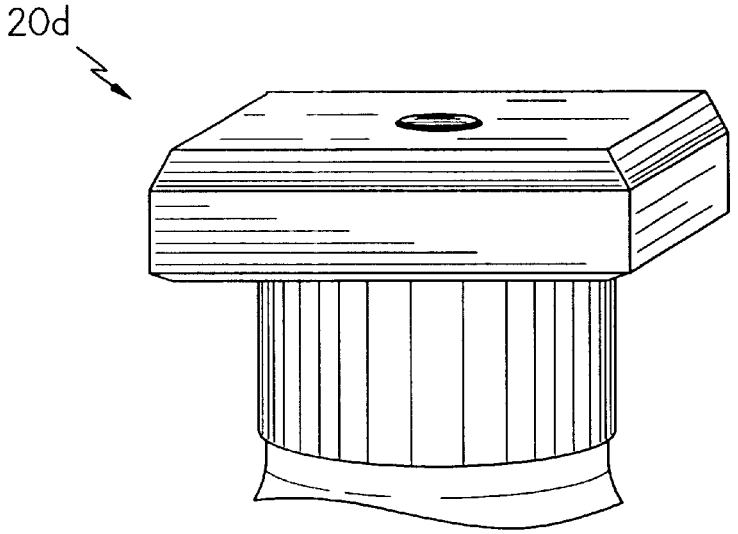
FIG. 20A is a modified version of the cap member.
Figure 20B:
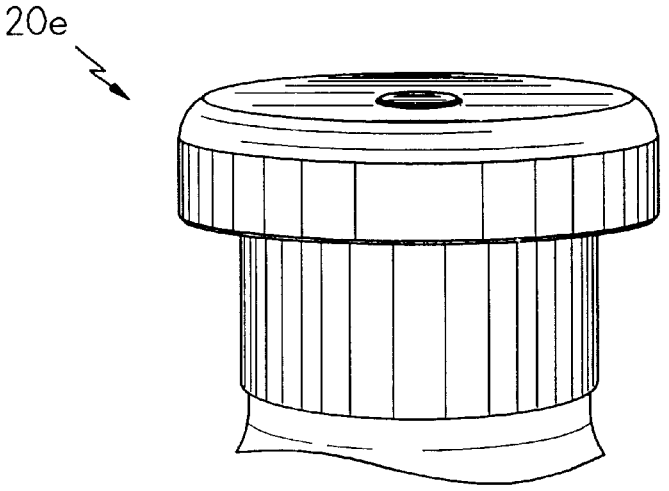
FIG. 20B is a further modification of the cap member having a shorter skirt than that shown in FIG. 19B.

FIGS. 20A and 20B show a further exemplary embodiment of the cap member. The cap shown in FIG. 20A is generally rectangular in form and is designated by the numeral 20*d*. In FIG. 20B, the cap has a short outer skirt, and is designated by the numeral 20*e*.

Figure 18A:
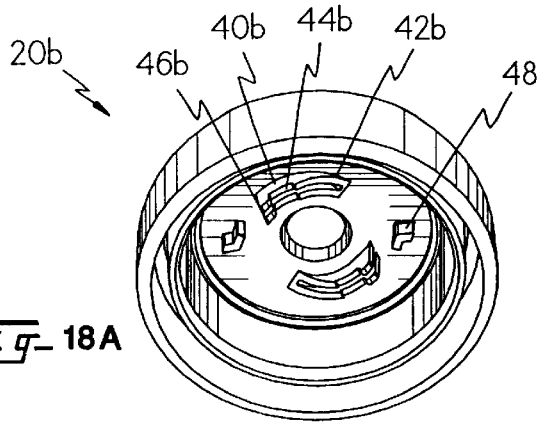
FIG. 18A is a perspective view of an exemplary modified cap member according to the present invention.
Figure 18B:
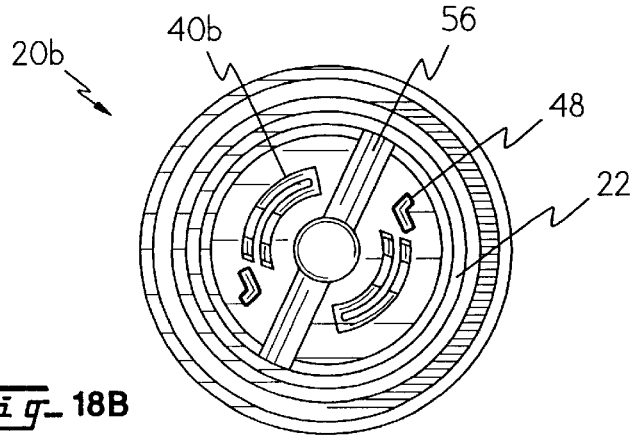
FIG. 18B is bottom plan view of an assembled container cap dispensing apparatus including the cap member of FIG. 18A.
Figure 18C:
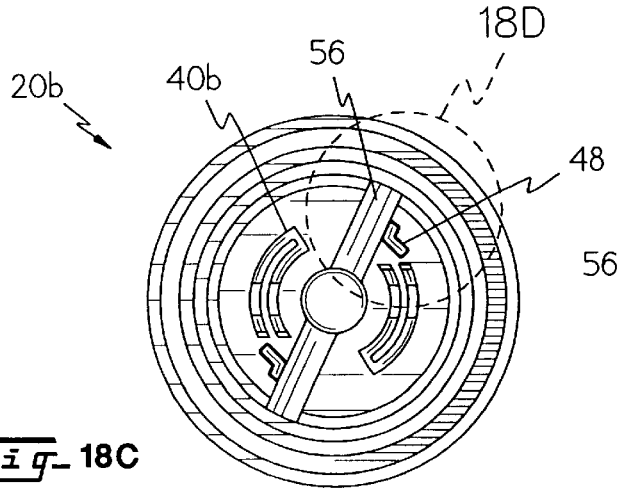
FIG. 18C is a bottom plan view showing the cap member rotated to a position where the strap 56 engages the stops 48.
Figure 18D:
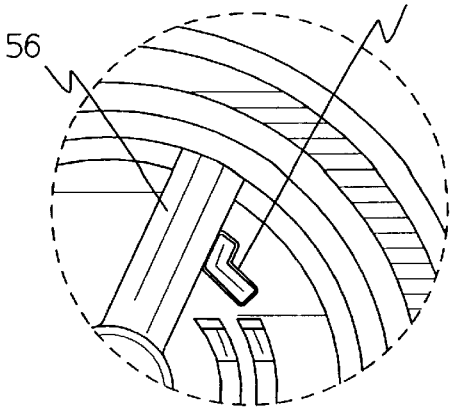
FIG. 18D is an exploded view of the portion shown by the area of FIG. 18C marked 18D.
Figure 21:
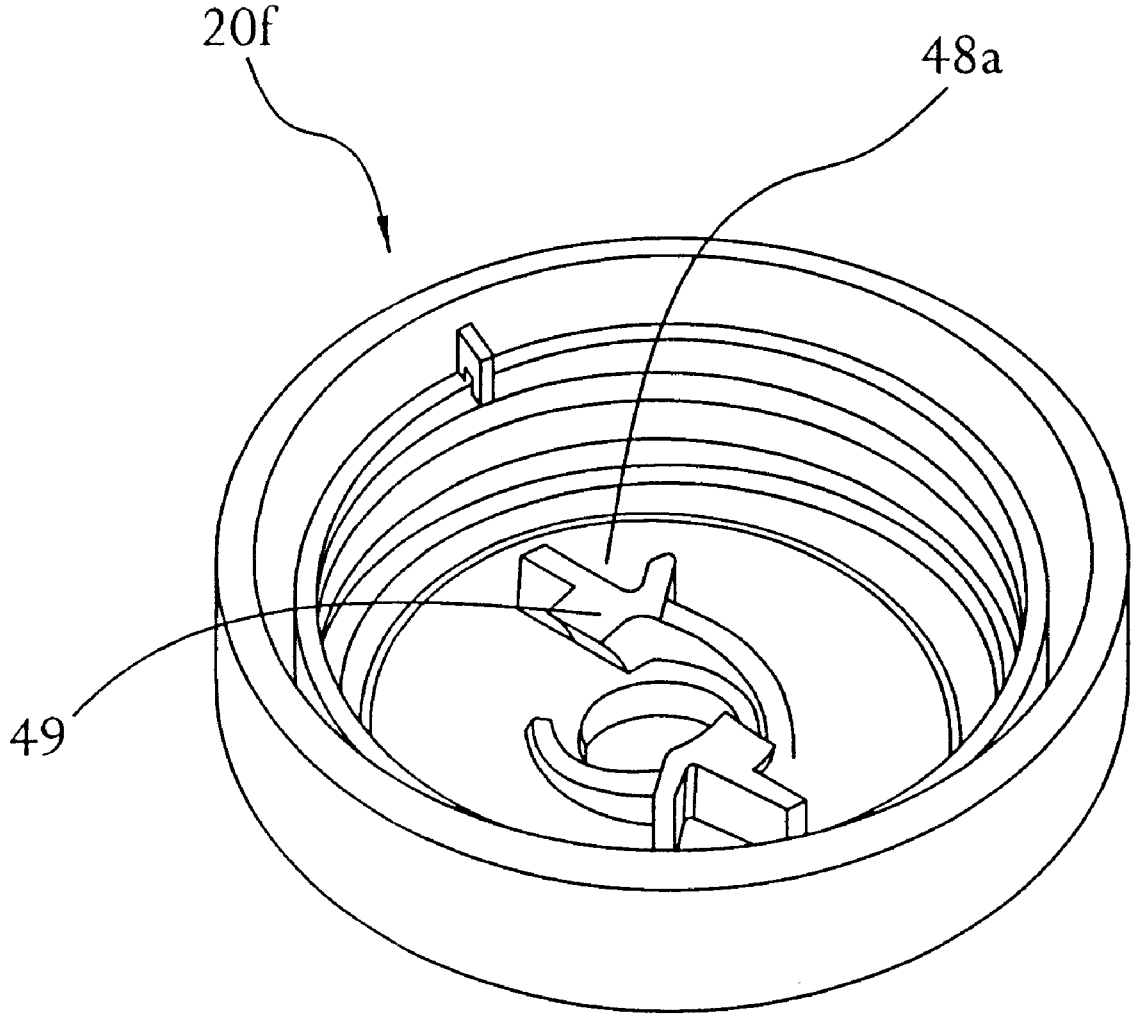
FIG. 21 is a perspective view of another exemplary embodiment of a cap member according to the present invention.

FIG. 21 is a perspective view of another exemplary embodiment of a cap member 20*f* according to the present invention. Cap member 20*f* includes a stop 48*a*. The stop 48*a* includes a protrusion, such as ledge 49, disposed to provide a positive lock for bridge strap 56 when the dispensing apparatus is rotated to its fully "closed" position, i.e., when the button 60 occupies discharge opening 30. Referring to FIG. 18D, stop 48 is shown engaging bridge strap 56 when the dispensing apparatus is rotated to the closed position. The button 60, however, may still be depressed if sufficient pressure is placed on the button from an external source, thereby enabling contents to flow out of discharge opening 30. Ledge 49 serves to fix bridge strap 56, and thus button 60, axially relative to the discharge opening 30 when the bridge strap 56 abuts the stop 48*a* in the fully closed position, thereby preventing the unwanted discharge of contents from a container secured to the dispensing apparatus of the present invention.

Although the invention has been described in terms of exemplary embodiments, it is not limited thereto. Rather, the appended claims should be construed broadly, to include other variants and embodiments of the invention which may be made by those skilled in the art without departing from the scope and range of equivalents of the invention.

What is claimed is:

1. A container cap dispensing apparatus, comprising:

(a) a base cap including:

a tubular body portion having a top end and a bottom end and a discharge opening located between said top and bottom ends;

a plug located near said top end;

a base portion located near said bottom end, said base portion including fastening means for securing said base cap to a container; and a flexible membrane connecting said tubular body portion to said base portion; and (b) a cover cap swivally mounted relative to said base cap, said cover cap including a top end and a bottom end and a dispensing opening near the top end thereof for discharging the contents of said container, said dispensing opening sized to selectively accept the plug of said base cap;

said base cap and cover cap including cooperable joining means including thread means for permitting said tubular body portion to be moved axially through a displacement of said flexible membrane when said cover cap is rotated relative to said base cap, whereby a discharge of the contents of said container is enabled.

2. The container cap dispensing apparatus of claim 1, further comprising a container secured to said base cap.

3. The container cap dispensing apparatus of claim 1, wherein said base cap forms a portion of a container.

4. The container cap dispensing apparatus of claim 1, wherein said flexible membrane is pleated.

5. The container cap dispensing apparatus of claim 1, wherein said cooperable joining means comprises an annular groove and an annular rib disposed within said annular groove to provide relative rotational movement between said cover cap and said base cap.

6. The container cap dispensing apparatus of claim 5, wherein said annular groove is located on said base cap and said annular rib is disposed on said cover cap.

7. The container cap dispensing apparatus of claim 5, wherein said annular groove is located on said cover cap and said annular rib is disposed on said base cap.

8. A container cap dispensing apparatus, comprising:

(a) a base cap including:

a body portion having a top end and a bottom end;

a plug located near said top end of said body portion;

a base portion located near said bottom end, said base portion including fastening means for securing said base cap to a container; and a plurality of flexible membrane spokes connecting said body portion to said base portion; and (b) a cover cap swivally mounted relative to said base cap, said cover cap including a top end and a bottom end and a dispensing opening near the top end thereof for discharging the contents of said container, said dispensing opening sized to selectively accept the plug of said base cap;

said base cap and cover cap including cooperable joining means including thread means for permitting said body portion to be moved axially through a displacement of said flexible membrane spokes when said cover cap is rotated relative to said base cap, whereby a discharge of the contents of said container is enabled.

9. The container cap dispensing apparatus of claim 8, further comprising a container secured to said base cap.

10. The container cap dispensing apparatus of claim 8, wherein said base cap forms a portion of a container.

11. The container cap dispensing apparatus of claim 8, wherein said flexible membrane spokes are pleated.

12. The container cap dispensing apparatus of claim 8, wherein said cooperable joining means comprises an annular groove and an annular rib disposed within said annular groove to provide relative rotational movement between said cover cap and said base cap.

13. The container cap dispensing apparatus of claim 12, wherein said annular grove is located on said base cap and said annular rib is disposed on said cover cap.

14. The container cap dispensing apparatus of claim 12, wherein said annular groove is located on said cover cap and said annular rib is disposed on said base cap.

15. A container assembly, comprising:

(a) a base cap including:

a tubular body portion having a top end and a bottom end and a discharge opening located between said top and bottom ends;

a plug located near said top end;

a base portion located near said bottom end, said base portion including fastening means for securing said base cap to a container; and a flexible membrane connecting said tubular body portion to said base portion;

(b) a container secured to said base cap; and (c) a cover cap swivally mounted relative to said container, said cover cap including a top end and a bottom end and a dispensing opening near the top end thereof for discharging the contents of said container, said dispensing opening sized to selectively accept the plug of said base cap;

said cover cap and said container including cooperable joining means for permitting said cover cap to rotate relative to said container and said base cap and cover cap including cooperable thread means for permitting said tubular body portion to be moved axially through a displacement of said flexible membrane when said cover cap is rotated relative to said container, whereby a discharge of the contents of said container is enabled.

16. The container assembly of claim 15, wherein said flexible membrane is pleated.

17. The container assembly of claim 15, wherein said cooperable joining means comprises an annular groove and an annular rib disposed within said annular groove to provide relative rotational movement between said cover cap and said container.

18. The container assembly of claim 17, wherein said annular groove is located on said cover cap and said annular rib is disposed on said container.

19. The container assembly of claim 17, wherein said annular groove is located on said container and said annular rib is disposed on said cover cap.

20. A container assembly, comprising:

(a) a base cap including:

a body portion having a top end and a bottom end;

a plug located near said top end of said body portion;

a base portion located near said bottom end, said base portion including fastening means for securing said base cap to a container; and a plurality of flexible membrane spokes connecting said body portion to said base portion;

(b) a container; and (c) a cover cap swivally mounted relative to said container, said cover cap including a top end and a bottom end and a dispensing opening near the top end thereof for discharging the contents of said container, said dispensing opening sized to selectively accept the plug of said base cap;

said cover cap and said container including cooperable joining means for permitting said cover cap to rotate relative to said container cap and said base cap and cover cap including cooperable thread means for permitting said body portion to be moved axially through a displacement of said flexible membrane spokes when said cover cap is rotated relative to said container, whereby a discharge of the contents of said container is enabled.

21. The container assembly of claim 20, wherein said flexible membrane spokes are pleated.

22. The container assembly of claim 20, wherein said cooperable joining means comprises an annular groove and an annular rib disposed within said annular grove to provide relative rotational movement between said cover cap and said container.

23. The container assembly of claim 22, wherein said annular groove is located on said cover cap and said annular rib is disposed on said container.

24. The container assembly of claim 22, wherein said annular groove is located on said container and said annular rib is disposed on said cover cap.

25. A container cap dispensing apparatus, comprising:

(a) a toggle sleeve member comprising a side wall defining a continuous passage through said toggle sleeve member from a top end of said toggle sleeve member to a bottom end of said toggle sleeve member, a fastening means for securing said toggle sleeve member to a container, a bridge strap extending across said passage and bowed toward said top end of said toggle sleeve member, and a button extending from said bridge strap toward said top end; and (b) a cap member disposed over a portion of said toggle sleeve member, said cap member comprising a top wall defining a discharge opening and disposed to accept said button, a skirt wall extending continuously from said top wall and over a portion of said toggle sleeve member, and a pair of diametrically opposed cam portions extending from a bottom surface of said top wall, one of said cap and toggle sleeve members including an annular groove, said annular groove mating with a protrusion extending from the other of said members, wherein said button is displaced from said discharge opening when said cap member is rotated along said annular groove through a camming of said bridge strap, whereby a discharge of the contents of said container is enabled.

26. The container cap dispensing apparatus of claim 25, further comprising a container secured to said toggle sleeve member.

27. The container cap dispensing apparatus of claim 25, wherein said toggle sleeve member includes said annular groove and said cap member includes said protrusion.

28. The container cap dispensing apparatus of claim 25, wherein said cap member includes said annular groove and said toggle sleeve member includes said protrusion.

29. The container cap dispensing apparatus of claim 25, wherein at least one of said cam portions includes a stop.

30. The container cap dispensing apparatus of claim 29, wherein said cam portions include an inclined ramp and a flat portion adjacent said ramp for seating said bridge strap when said cap member is rotated to displace said button from said discharge opening.

31. The container cap dispensing apparatus of claim 30, wherein said flat portion is a cut-out portion for positively seating said bridge strap.

32. The container cap dispensing apparatus of claim 25, wherein said cap member includes at least one stop extending from said bottom surface of said top wall of said cap member, said stop disposed to engage said bridge strap when said cap member is rotated such that said button occupies said discharge opening.

33. The container cap dispensing apparatus of claim 32, wherein said stop includes a protrusion extending from said stop, said protrusion disposed to lock said bridge strap such that said button is fixed axially relative to said discharge opening when said cap member is rotated such that said button occupies said discharge opening.

34. The container cap dispensing apparatus of claim 25, wherein said protrusion is an annular rib.

35. The container cap dispensing apparatus of claim 25, wherein said skirt has a U-shaped cross-section.

* * * * *